US006536529B1

(12) United States Patent
Kerr et al.

(10) Patent No.: US 6,536,529 B1
(45) Date of Patent: Mar. 25, 2003

(54) COMMUNICATING COMMANDS TO A WELL TOOL

(75) Inventors: John A. Kerr, Sugar Land, TX (US); Roderick MacKenzie, Sugar Land, TX (US); Vladimir Vaynshteyn, Moscow rural (RU)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/712,823

(22) Filed: Nov. 14, 2000

Related U.S. Application Data

(63) Continuation-in-part of application No. 09/310,670, filed on May 12, 1999, now Pat. No. 6,182,764

(60) Provisional application No. 60/086,909, filed on May 27, 1998.

(51) Int. Cl.[7] ..... E21B 34/16

(52) U.S. Cl. ..... 166/375; 166/363

(58) Field of Search ..... 166/373, 375, 166/363, 364, 360, 65.1

(56) References Cited

U.S. PATENT DOCUMENTS 4,212,355 A * 7/1980 Reardon ..... 166/320
4,896,722 A 1/1990 Upchurch
4,915,168 A * 4/1990 Upchurch ..... 166/250.15
4,953,618 A 9/1990 Hamid et al.
5,044,442 A * 9/1991 Nobileau ..... 166/182
5,515,336 A 5/1996 Chin et al.
5,963,138 A 10/1999 Gruenhagen
5,971,077 A * 10/1999 Lilley ..... 166/348
6,182,764 B1 * 2/2001 Vaynshteyn ..... 166/373
6,293,344 B1 * 9/2001 Nixon et al. ..... 166/321
6,321,846 B1 * 11/2001 Rytlewski ..... 166/363

FOREIGN PATENT DOCUMENTS

EP 0 344 060 A2 11/1989
EP 0 604 134 A1 6/1994

* cited by examiner

*Primary Examiner*—David Bagnell
*Assistant Examiner*—John Kreck
(74) *Attorney, Agent, or Firm*—Trop Pruner & Hu; Jeffrey E. Griffin; Brigitte Jeffery

(57) ABSTRACT

A system for use with a subsea well that includes a BOP includes a fluid line and a tool that is not connected to the fluid line. The fluid line is connected to the BOP to communicate a pressure encoding a command, and the tool is adapted to decode and respond to the command when the tool is inside the BOP.

23 Claims, 23 Drawing Sheets

COMMUNICATING COMMANDS TO A WELL TOOL

CROSS-REFERENCE TO RELATED APPLICATIONS

This application claims priority under 35 U.S.C. §120 to U.S. patent application Ser. No. 09/310,670 entitled, "Generating Commands for a Downhole Tool," filed on May 12, 1999, now U.S. Pat. No. 6,182,764 which claims the benefit of U.S. Provisional Patent Application Serial No. 60/086,909 entitled, "Generating Commands for a Downhole Tool," filed on May 27, 1998.

BACKGROUND

The invention generally relates to communicating commands to a well tool.

Referring to FIG. 1, for purposes of measuring characteristics (e.g., formation pressure) of a subterranean formation 31, a tubular string 10 may be inserted into a wellbore which extends into the formation 31. In order to test a particular region, or zone 33, of the formation 31, the string 10 may include a perforating gun 30 that is used to penetrate a well casing 12 and form fractures 29 in the formation 31. To seal off the zone 33 from the surface of the well, the string 10 typically includes a packer 26 that forms a seal between the exterior of the string 10 and the internal surface of the well casing 12. Below the packer 26, a recorder 11 of the string 10 takes measurements of the formation 31.

The tool 21 typically has valves to control the flow of fluid into and out of a central passageway of the string 10. An in-line ball valve 22 is used to control the flow of well fluid from the formation 31 up through the central passageway of the test string 10. Above the packer 26, a circulation valve 20 is used to control fluid communication between an annulus 16 surrounding the string 10 and the central passageway of the string 10.

The ball valve 22 and the circulation valve 20 can be controlled by commands (e.g., "open valve" or "close valve") that are sent downhole. Each command is encoded into a predetermnined signature of pressure pulses 34 (FIG. 2) transmitted downhole to the tool 21 via hydrostatic fluid present in the annulus 16. A sensor 25 of the tool 21 receives the pressure pulses 34, and the command is extracted. Electronics and hydraulics of the string 10 then operate the valves 20 and 22 to execute the command.

For purposes of generating the pressure pulses 34, a port 18 in the casing 12 extends to a manually operated pump (not shown). The pump is selectively turned on and off by an operator to encode the command into the pressure pulses 34. A duration $T_0$ (e.g., 1 min.) of the pulse 34, a pressure $P_0$ (e.g., 250 p.s.i.) of the pulse 34, and the number of pulses 34 in succession form the signature that uniquely identifies the command.

FIG. 1 depicts a land-based well. However, similar pressure pulses may be used to communicate commands to a well tool that is disposed in a subsea well. For example, a subsea well may have a Blowout Preventor (BOP) that is located just above surface of the sea floor and is connected, at its lower end to a wellhead of the well and to the surface vessel by a pressure containing conduit known as a marine riser. The BOP stack forms a sealed entry point to the well as well as other devices, such as a tubing hanger (for example), a mechanism that, as its name implies, holds the top end of production tubing that extends down into the well bore. For purposes of installing the tubing hanger inside the well, a tool called a tubing hanger running tool (THRT) may be used, and this tool may be actuated via pressure pulses.

More specifically, the tubing hanger running tool may be tethered to a floating platform at the surface of the well. In this manner, a tubing called a landing string may be connected between the surface floating vessel/rig/platform and the THRT within a marine riser, onto which an umbilical containing hydraulic and electrical conduits may be clamped externally for the purpose of communication with the THRT. The long umbilical that is used to communicate commands to the tubing hanger running tool may be significantly expensive and may significantly increase the time needed to deploy and retrieve the tool.

Thus, there is a continuing need for an arrangement that addresses one or more of the problems that are stated above.

SUMMARY

In an embodiment of the invention, a system for use with a subsea well that includes a BOP includes a fluid line and a tool that is not connected to the fluid line. The fluid line is connected to the BOP to communicate a pressure encoding a command, and the tool is adapted to decode and respond to the command when the tool is inside the BOP.

Advantages and other features of the invention will become apparent from the following description, drawing and claims.

DETAILED DESCRIPTION

Figure 1:
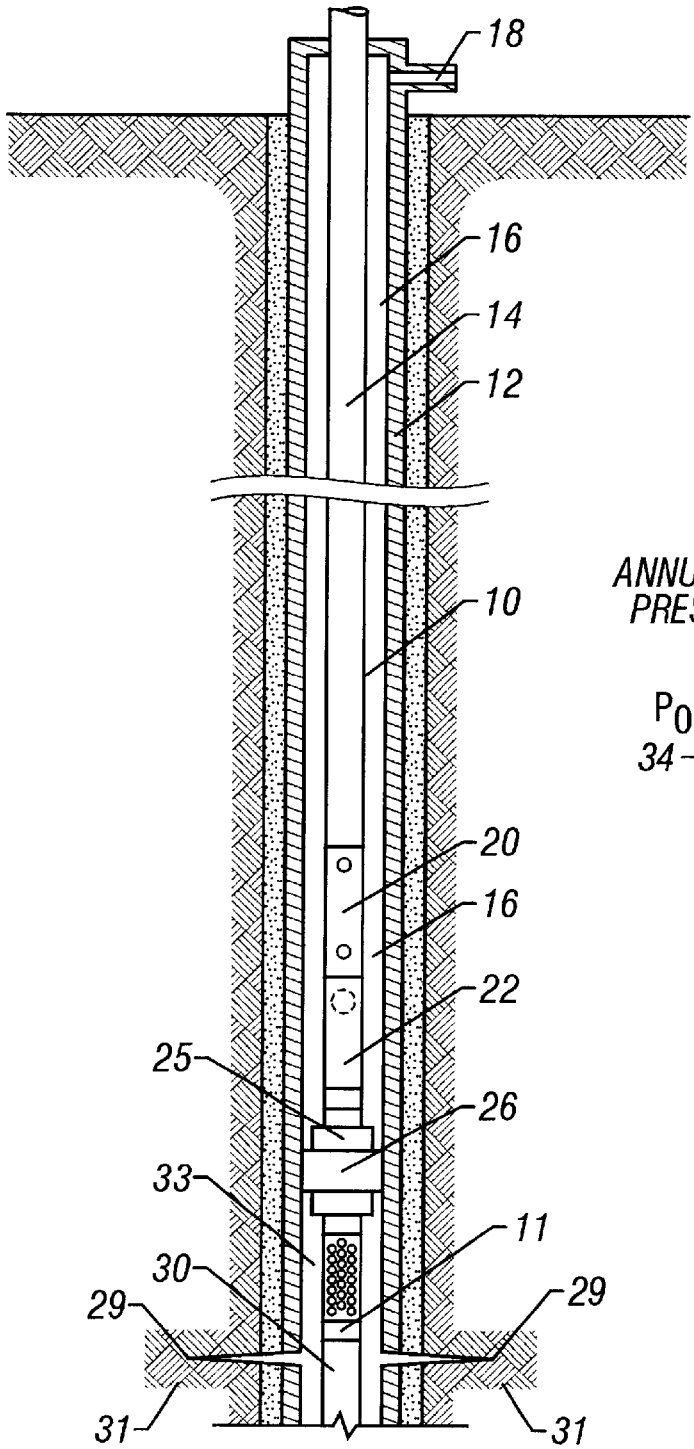
FIG. 1 (Prior Art)
FIG. 1 is a schematic view of a test string in a well being tested.
Figure 2:
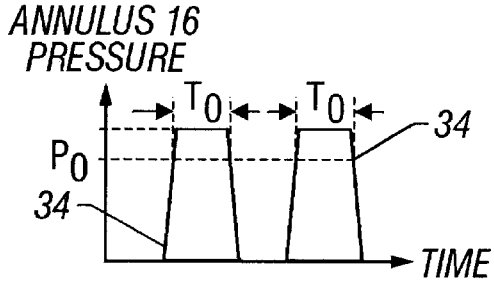
FIG. 2 (Prior Art)
FIG. 2 is a waveform illustrating a pressure pulse command for a tool of the test string of FIG. 1.
Figure 3A:
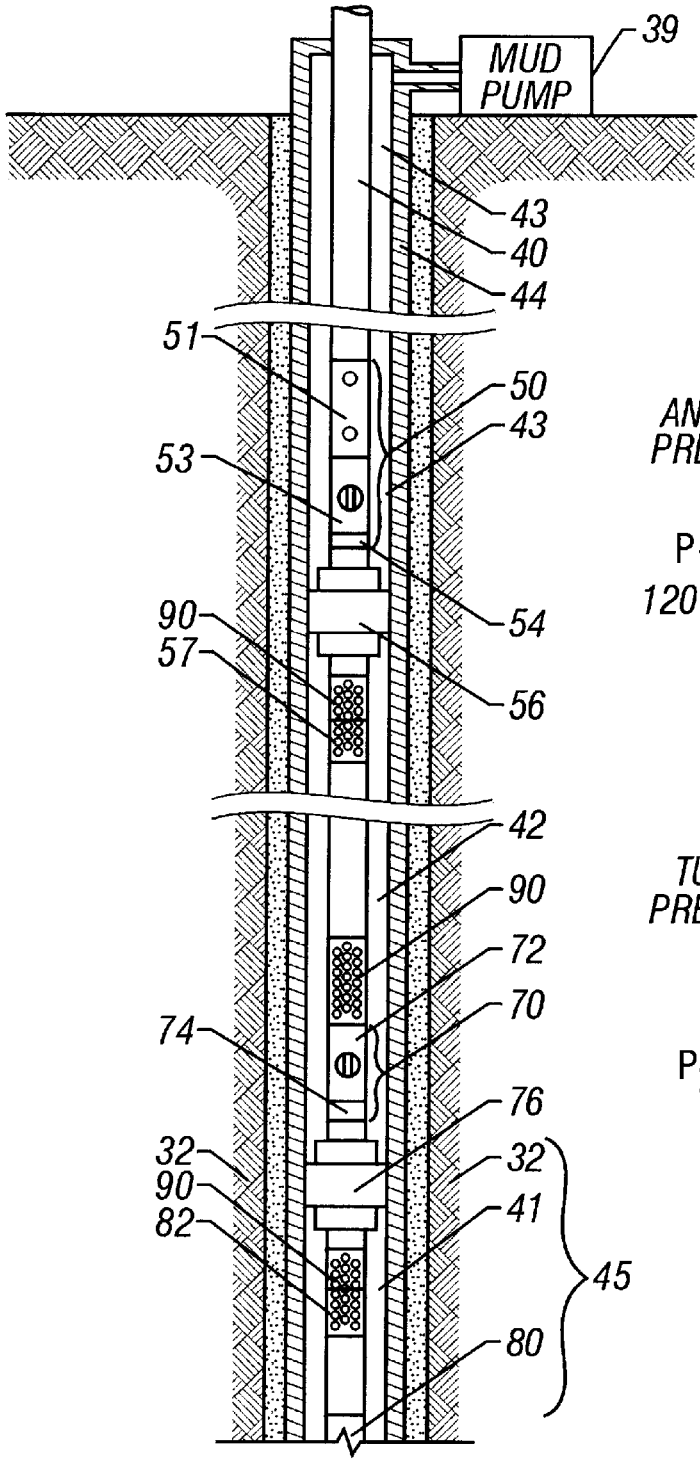
FIGS. 3A, and 4–9 are schematic views of a string that includes multiple valves and packers.
Figure 3B:
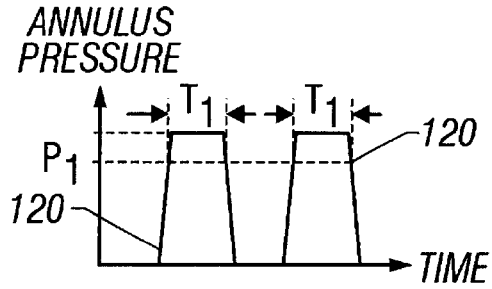
FIGS. 3B and 3C are waveforms illustrating pressure pulses transmitted to tools of the test string.
Figure 3C:
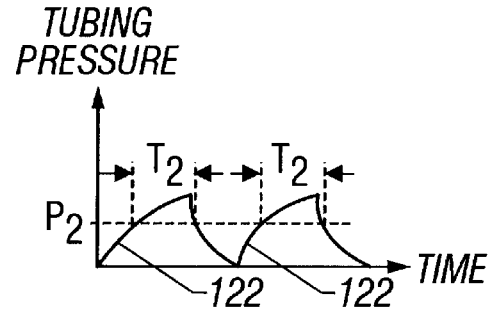

As shown in FIGS. 3A–3C, a tubular test string 40 having two in-line testing tools 50 and 70 is located inside a well. To send a command (e.g., "open valve" or "close valve") downhole to the upper tool 50, a mud pump 39 is used to encode the command into a series of pressure pulses 120 (i.e., a command stimulus) which are applied to hydrostatic fluid present in an upper annulus 43. The upper tool 50 has a sensor 54 in contact with the hydrostatic fluid in the upper annulus 43. The upper tool 50 uses the sensor 54 to identify the signature of the pressure pulses 120 and, thus, extract the encoded command. In response to the appropriate commands, the upper tool 50 is constructed to actuate an in-line ball valve 53 and/or a circulation valve 51.

The upper annulus 43 is the annular space above a packer 56 which forms a seal between the exterior of the upper tool 50 and the interior of a well casing 44. Because the lower tool 70 is located below the packer 56, the fluid in the upper annulus 43 cannot be used as a medium to directly send pressure pulses (and thus commands) to the lower tool 70. However, because a central passageway of the test string 40 extends through the packer 56, this central passageway may be used as a conduit for passing commands to the lower tool 70. As described below, commands are sent to the lower tool 70 by using the ball valve 53 of the upper tool 50 to form pressure pulses 122 in well fluid (e.g., oil, gas, water, or a mixture of these fluids) present in a lower annulus 42 below the packer 56. The lower tool 70 has a sensor 74 in contact with fluid in the lower annulus 42. The lower tool 70 uses the sensor 74 to receive the pulses 122 and, thus, extract the commands sent by the upper tool 50.

Thus, commands are sent to the lower tool 70 by the upper tool 50. More particularly, to send a command to the lower tool 70, the mud pump 39 first creates pressure pulses 120 in the fluid in the upper annulus 43. The pressure pulses may be either negative or positive changes in pressure (relative to a baseline pressure level), and the pressure pulses 120 form a signature that indicates a command for the lower tool 70. In this manner, the upper tool 50 receives the pressure pulses 120, decodes the command from the pulses 120, and selectively opens and closes the ball valve 53 to send the command to the lower tool 70 via pressure pulses 122. The pressure pulses 122 are applied to a column of well fluid existing in the central passageway of the string 40 where the string 40 extends through the packer 56. Perforated tailpipes 90 of the string 40 establish fluid communication between the central passageway of the string 40, the annulus 43, an annulus 42 and an annulus 41. For example, perforated tailpipes 90 may be located above and below a perforating gun 57 (of the string 40) that is located in the annulus.42. In this manner, the tailpipes 90 establish fluid communication between the central passageway of the string 40 and the annulus 42. Thus, due to this arrangement, the pressure pulses 122 that are formed by the upper tool 50 propagate to the lower annulus 42. As a result, the lower tool 70 uses the sensor 74 to identify the unique signature of the pulses 122 and thus, extract the command. After extracting the command, the lower tool 70 executes the command.

The advantages of the above-described arrangement may include one or more of the following: tools below the packer may be controlled without extending wires or pressurized hydraulic lines through the packer; additional electronics may not be required; and additional hydraulics may not be required.

Besides the sensor 54 and.the ball valve 53, the upper tool 50 may include a circulation valve 51 and electronics that are configured to decode the signature of the pressure pulses 120 and to control the valves 53 and 51 accordingly. A recorder (not shown) may be located below the packer 56 for taking measuring characteristics of fluid in the lower annulus 42.

In some embodiments, the string 40 may includes a perforated tailpipe 90 that is located above a ball valve 72 of the lower tool 70. As controlled by the ball valve 72, the tailpipe 71 allows fluid communication between the lower annulus 42 and a central passageway of the string 40 that extends through the packer 76. The packer 76 forms a seal between the exterior of the lower tool 70 and the interior of the well casing 44, thereby forming a test zone 45 and an annulus 41 below the packer 76.

The lower tool 70 also has electronics to decode the pressure pulses 122 and to operate the ball valve 72 accordingly. Located below the packer 76 are a perforating gun 82 that may be between two perforated tailpipes 90 that establish fluid communication between the central passageway of the test string 40 (extending through the packer 76) and the annulus 41, as controlled by the ball valve 72. A recorder 80 may also be located below the packer 76 to take measurements in the test zone 45.

As an example, the string 40 may be inserted into the well to perforate and measure characteristics of a formation 32 using a process, such as is described below. The circulation valve 51 remains closed except when fluid communication between the upper annulus 42 and the central passageway of the string 40 needs to be established.

Figure 4:
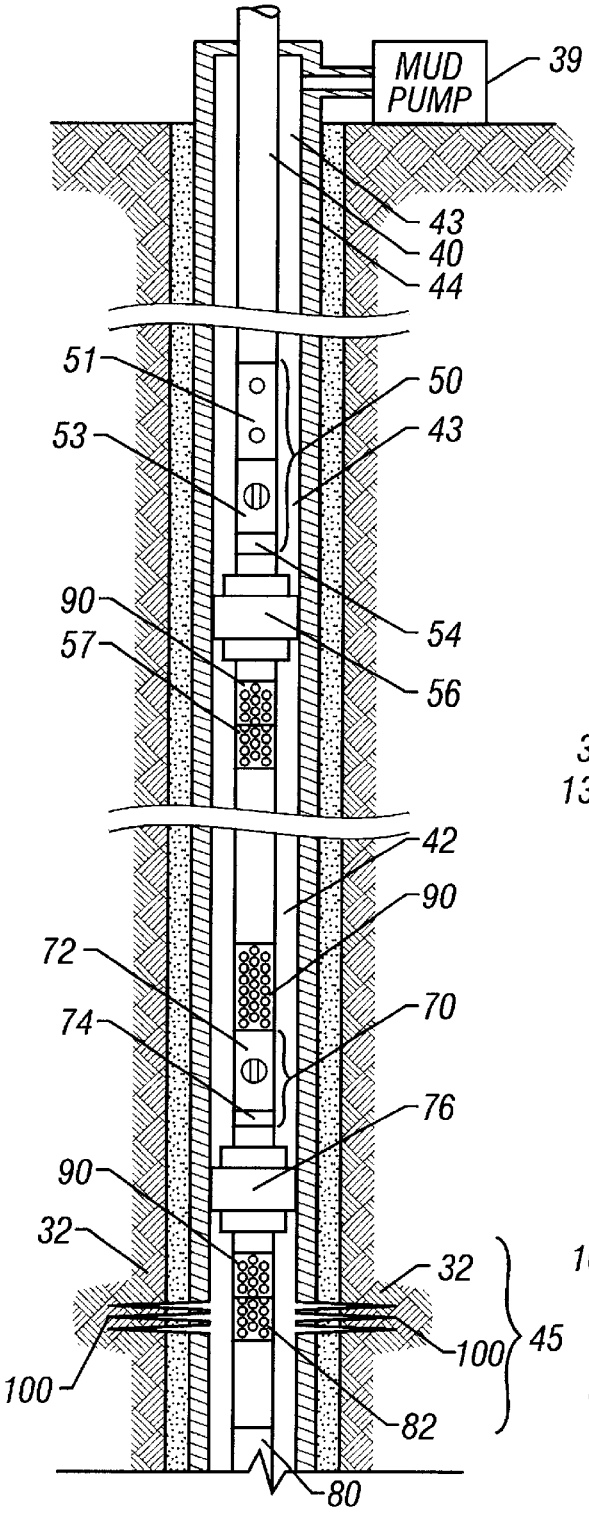

To begin the process, as shown in FIG. 3A, the test string 40 is inserted into the well with both ball valves 53 and 72 opened. Next, as shown in FIG. 4, pressure is applied through the tubular test string 40 to detonate the perforating gun 82. When detonated, shape charges in the gun 82 form lateral fractures 100 in the formation 32 and well casing 44 below the packer 76.

Figure 5:
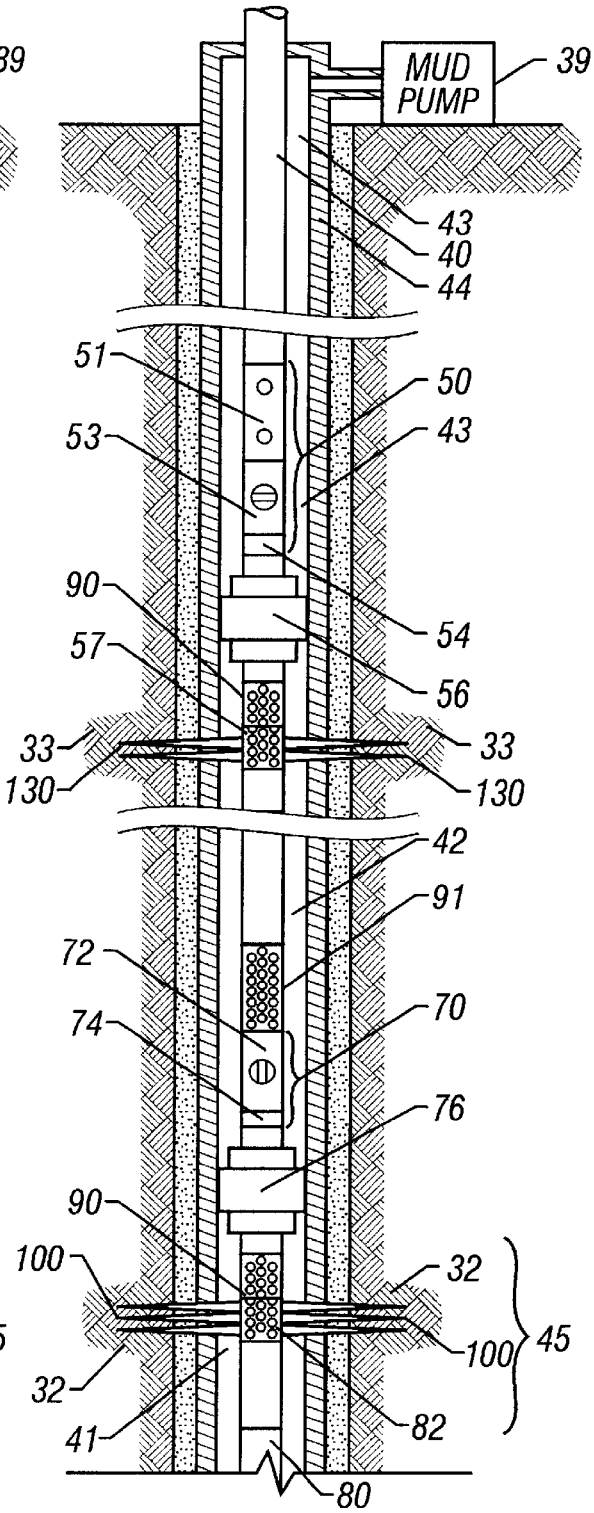

As shown in FIG. 5, once the perforations 100 are formed, the mud pump 39 is used to send a command to the upper tool 50 to close the ball valve 53. Tests are then conducted in the zone 45 to measure characteristics of the perforations 100. After the tests are complete, a column of well fluid exists in the central passageway of the test string 40 below the ball valve 53.

Figure 6:
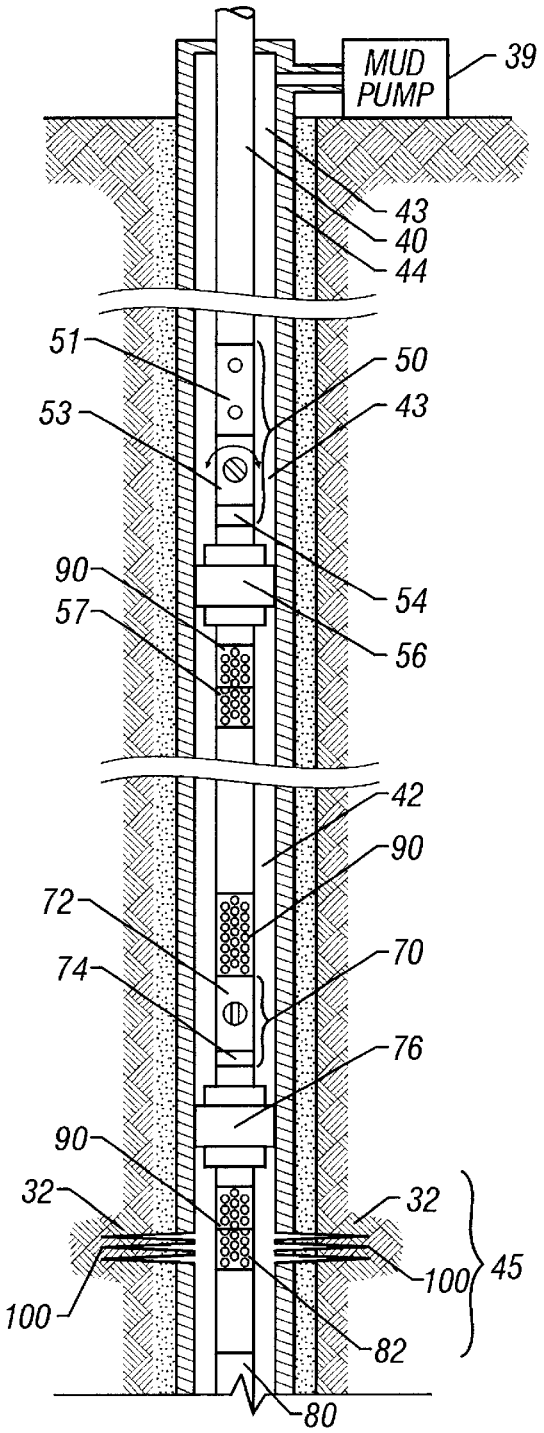

As shown in FIG. 6, once the testing of the zone 45 is complete, a process is performed to seal off the zone 45. To accomplish this, the mud pump 39 instructs the upper tool 50 to open and close the ball valve 53 in a manner to generate pressure pulses in the column of well fluid below the ball valve 53. These pressure pulses have a predetermined signature indicative of a command for the lower tool 70 to close the ball valve 72. When the lower tool 70 recognizes this signature (via the sensor 74), the lower tool 70 closes the ball valve 72 and seals off the zone 45.

Figure 7:
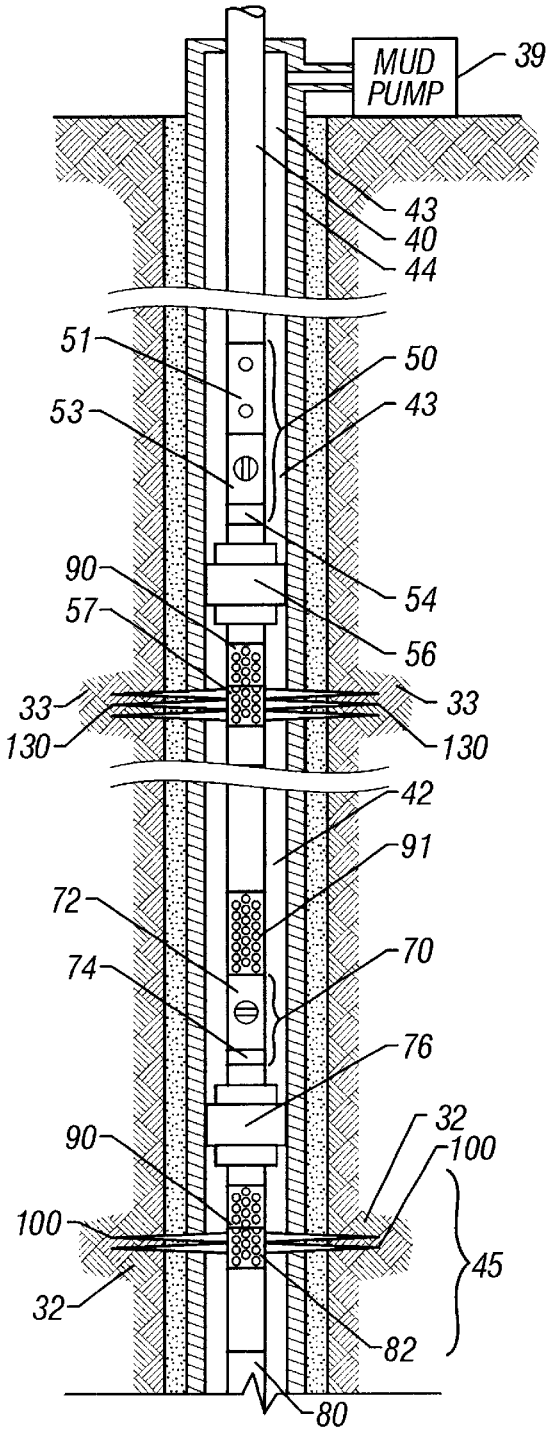

As shown in FIG. 7, once the ball valve 72 has been closed, the perforating gun 59 is detonated to form another set of perforations 130 in another formation 33. Because the ball valve 53 is open, the well fluid flows upwardly through the perforated tailpipe 57 and past the packer 56. The formation 33 is then tested using the upper tool 50.

Figure 8:
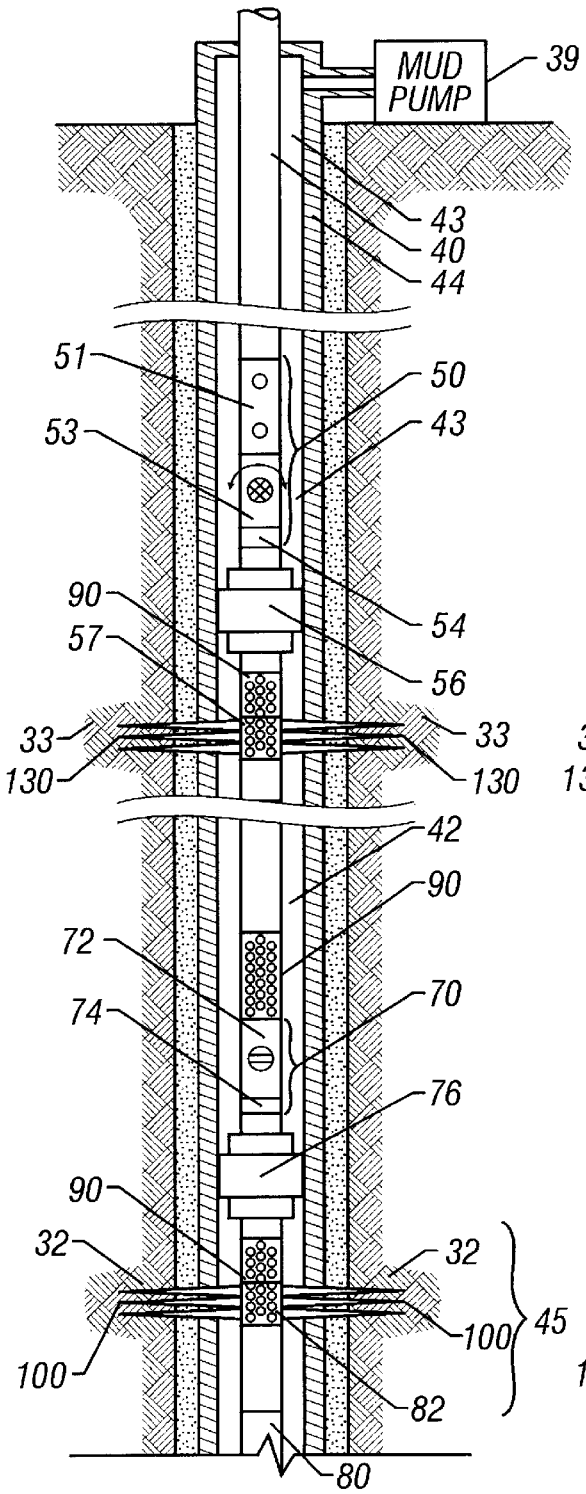
Figure 9:
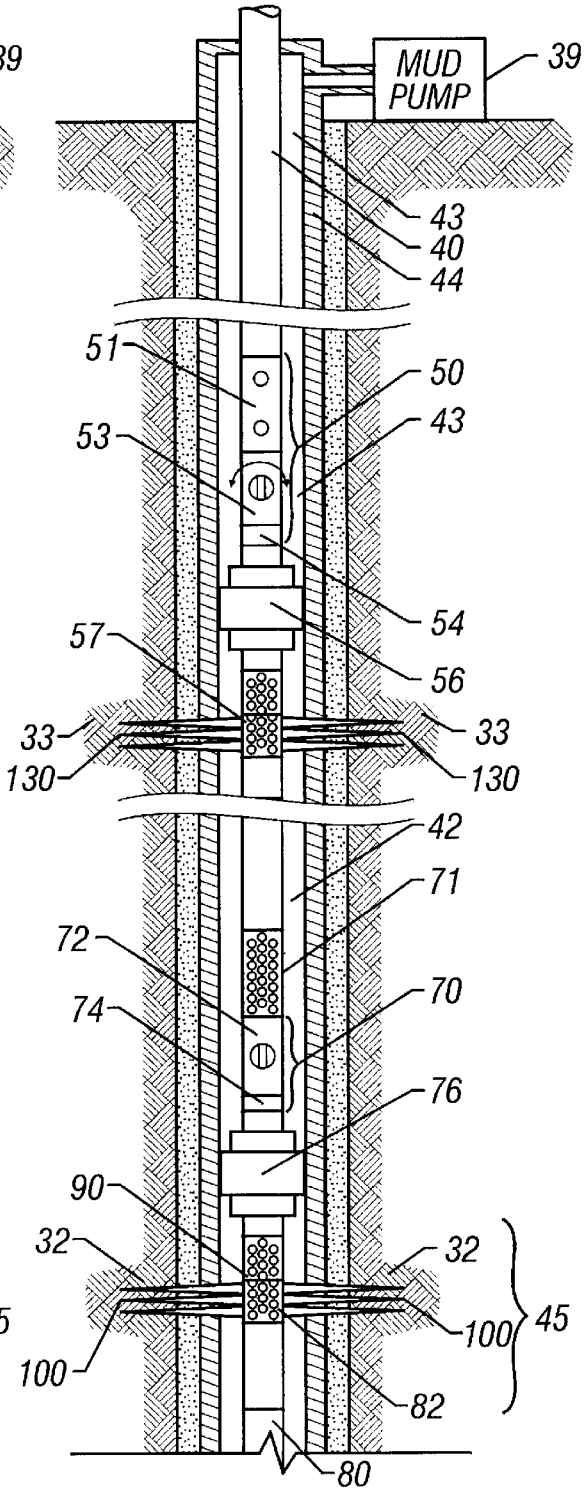

As shown in FIG. 8, once the testing of the formation 33 is complete, the mud pump 39 then sends commands to the upper tool 50 to open and close the ball valve 53 in a manner to generate pressure pulses in the column of well fluid below the ball valve 53. These pressure pulses have a predetermined-signature indicative of a command for the lower tool 70 to open the ball valve 72. When the lower tool 70 recognizes this signature, the lower tool 70 opens the ball valve 72, and the formations 32 and 33 are tested together.

The testing procedure described above requires that a column of well fluid exists below the ball valve 53. Sufficient pressure (typically exerted by the fluid in the formations 32 and 33) must also be exerted on the column so that the opening and closing of the valve 53 produces pressure variations (FIG. 3B) large enough for the sensor 74 to detect. If the formations 32 and 33 do not exert sufficient pressure, the circulation valve 51 maybe opened and another fluid, such as a light gas (e.g., nitrogen), is injected into the central passageway of the string 40 above the ball valve 53. The gas displaces the well fluid above the valve 53 to reduce the hydrostatic pressure above the ball valve 53 and create a pressure difference necessary for generating the pressure pulses 122. Alternatively, a fluid, such as a formation "kill" fluid, may be injected into the central passageway of the string 40 and the lower annulus 42 so that the pump 39 may be used to send commands to the tool 70.

Figure 10:
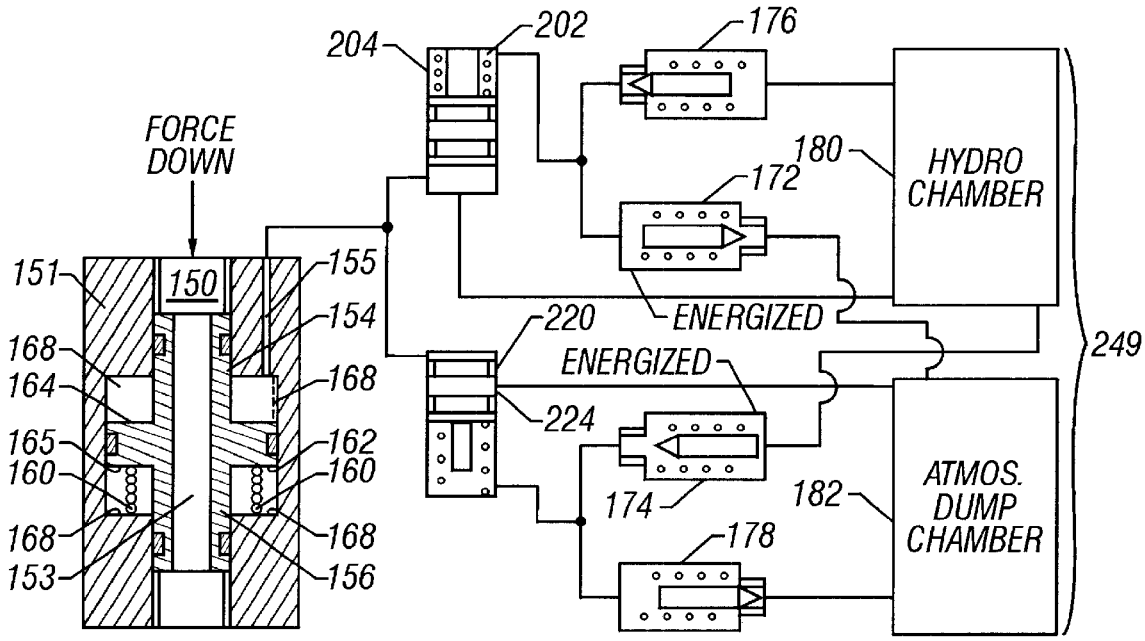
FIG. 10 is a block diagram of a hydraulic system to control valves of the tools.

Each of the tools 50 and 70 use hydraulics 249 (FIG. 10) and electronics 250 (FIG. 11) to operate the valves. As shown in FIG. 10, each valve uses a hydraulically operated tubular member 156 which through its longitudinal movement, opens and closes one of the valves. The member 156 is slidably mounted inside a tubular housing 151 of the test string 40. The member 156 includes a tubular mandrel 154 having a central passageway 153 coaxial with a central passageway 150 of the housing 151. The member 156 also has an annular piston 162 radially extending from the exterior of the mandrel 154. The piston 162 resides inside a chamber 168 formed in the tubular housing 151.

The member 156 is forced up and down by using a port 155 in the housing 151 to change the force applied to an upper face 164 of the piston 162. Through the port 155, the face 164 is subjected to either a hydrostatic pressure (a pressure greater than atmospheric pressure) or to atmospheric pressure. A compressed coiled spring 160 contacting a lower face 165 of the piston 162 exerts upward forces on the piston 162. When the upper face 164 is subject to atmospheric pressure, the spring 160 forces the member 156 upward. When the upper face 164 is subject to hydrostatic pressure, the piston 162 is forced downward.

The pressures on the upper face 164 are established by connecting the port 155 to either a hydrostatic chamber 180 (furnishing hydrostatic pressure) or an atmospheric dump chamber 182 (furnishing atmospheric pressure). Four solenoid valves 172–178 and two pilot valves 204 and 220 are used to selectively establish fluid communication between the chambers 180 and 182 and the port 155.

The pilot valve 204 controls fluid communication between the hydrostatic chamber 180 and the port 155, and the pilot valve 220 controls fluid communication between the atmospheric dump chamber 182 and the port 155. The pilot valves 204 and 220 are operated by the application of hydrostatic and atmospheric pressure to control ports 202 (pilot valve 204) and 224 (pilot valve 220). When hydrostatic pressure is applied to the control port the valve is closed, and when atmospheric pressure is applied to the control port, the valve is open.

The solenoid valve 176 controls fluid communication between the hydrostatic chamber 180 and the control port 202. When the solenoid valve 176 is energized, fluid communication is established between the hydrostatic chamber 180 and the control port 202, thereby closing the pilot valve 204. The solenoid valve 172 controls fluid communication between the atmospheric dump chamber 182 and the control port 202. When the solenoid valve 172 is energized, fluid communication is established between the atmospheric dump chamber 182 and the control port 202, thereby opening the pilot valve 204.

The solenoid valve 174 controls fluid communication between the hydrostatic chamber 180 and the control port 224. When the solenoid valve 174 is energized, fluid communication is established between the hydrostatic chamber 180 and the control port 224, thereby closing the pilot valve 220. The solenoid valve 178 controls fluid communication between the atmospheric dump chamber 182 and the control port 224. When the solenoid valve 178 is energized, fluid communication is established between the atmospheric dump chamber 182 and the control port 224, thereby opening the pilot valve 220.

Thus, to force the moving member 156 downward, (which opens the valve) the electronics 250 of the tool energize the solenoid valves 172 and 174. To force the moving member 156 upward (which closes the valve), electronics 250 energize the solenoid valves 176 and 178. The hydraulics of the tool are further described in U.S. Pat. No. 4,915,168, entitled "Multiple Well Tool Control Systems in a Multi-Valve Well Testing System," which is hereby incorporated by reference.

Figure 11:
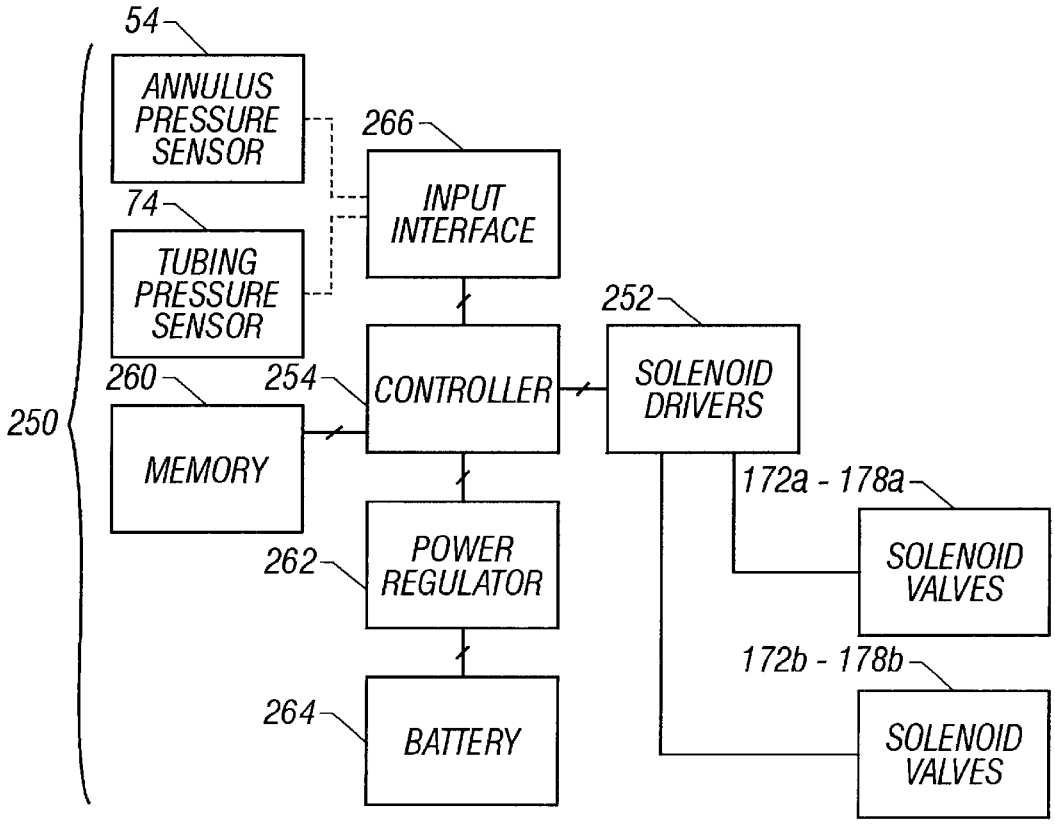
FIG. 11 is a block diagram of electronics to control valves of the tools.

As shown in FIG. 11, the electronics 250 for each of the tools 50 and 70 include a controller 254 which, through an input interface 266, may monitor an annulus pressure sensor (e.g., the sensor 54 or 74). Based on the command pressure pulses received by these, the controller 254 uses solenoid drivers 252 to operate the solenoid valve set 172*a*–178*a* for the ball valve and a solenoid valve set 172*b*–178*b* for the circulation valve.

The controller 254 executes programs stored in a memory 260. The memory 260 may either be a non-volatile memory, such as a read only memory (ROM), an electrically erasable programmable read only memory (EEPROM), or a programmable read only memory (PROM). The memory 260 may be a volatile memory, such as a random access memory (RAM). The battery 264 (regulated by a power regulator 262) furnishes power to the controller 254 and the other electronics of the tool.

Figure 12:
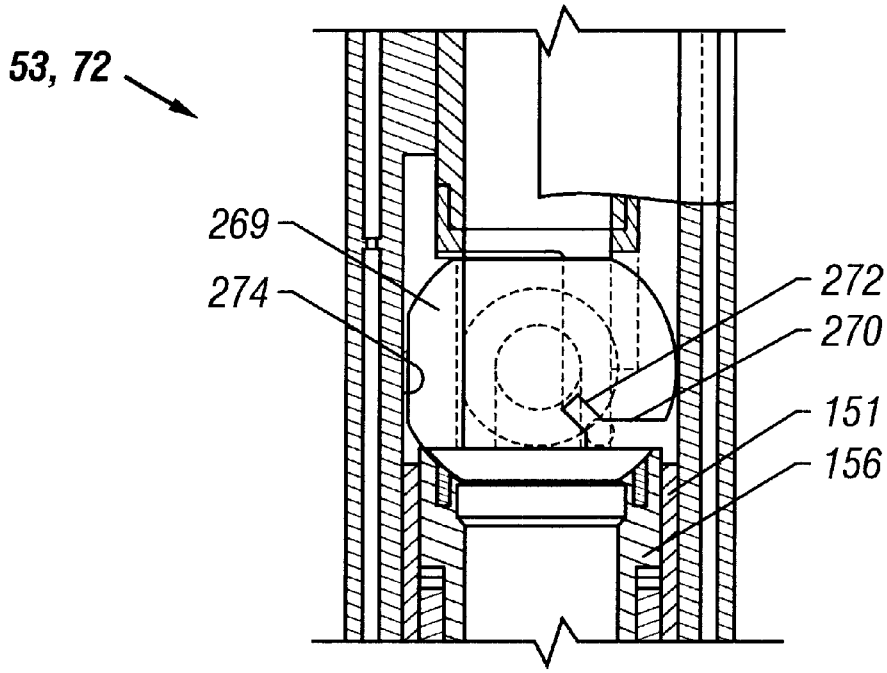
FIG. 12 is a cut-away view of the test string illustrating operation of the ball valve.

As shown in FIG. 12, each of the ball valves 53 and 72 includes a spherical ball element 269 which has a through passage 274. An arm 275 attached to the moving member 156 engages an eccentric lug 270 which is attached through radial slots 272 to the element 269. By moving the member 156 up and down, the ball element 269 rotates on an axis perpendicular to the coaxial axis of the central passageway 150, and the through passage 274 moves in and out of the central passageway 150 to open and close the ball valve, respectively.

Figure 13:
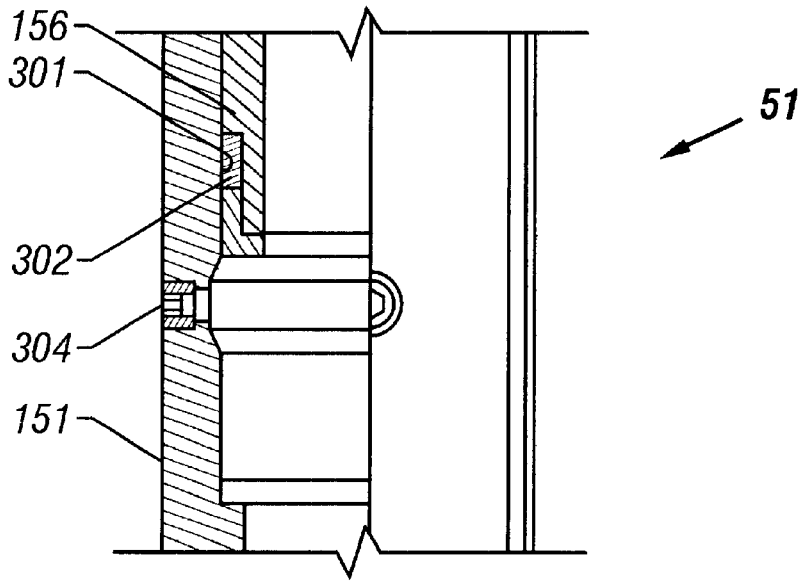
FIG. 13 is a cut-away view of the test string illustrating operation of the circulation valve.

As shown in FIG. 13, for the circulation valve 51, the housing 151 has a radial port 304 extending from outside of the tool, through the housing 151, and into the central passageway 150. A seal 302 located in a recess 301 on the exterior of the member 156 is used to open and close the circulating port 304. By moving the member 156 up and down, the circulation valve 51 is opened and closed, respectively.

Figure 14:
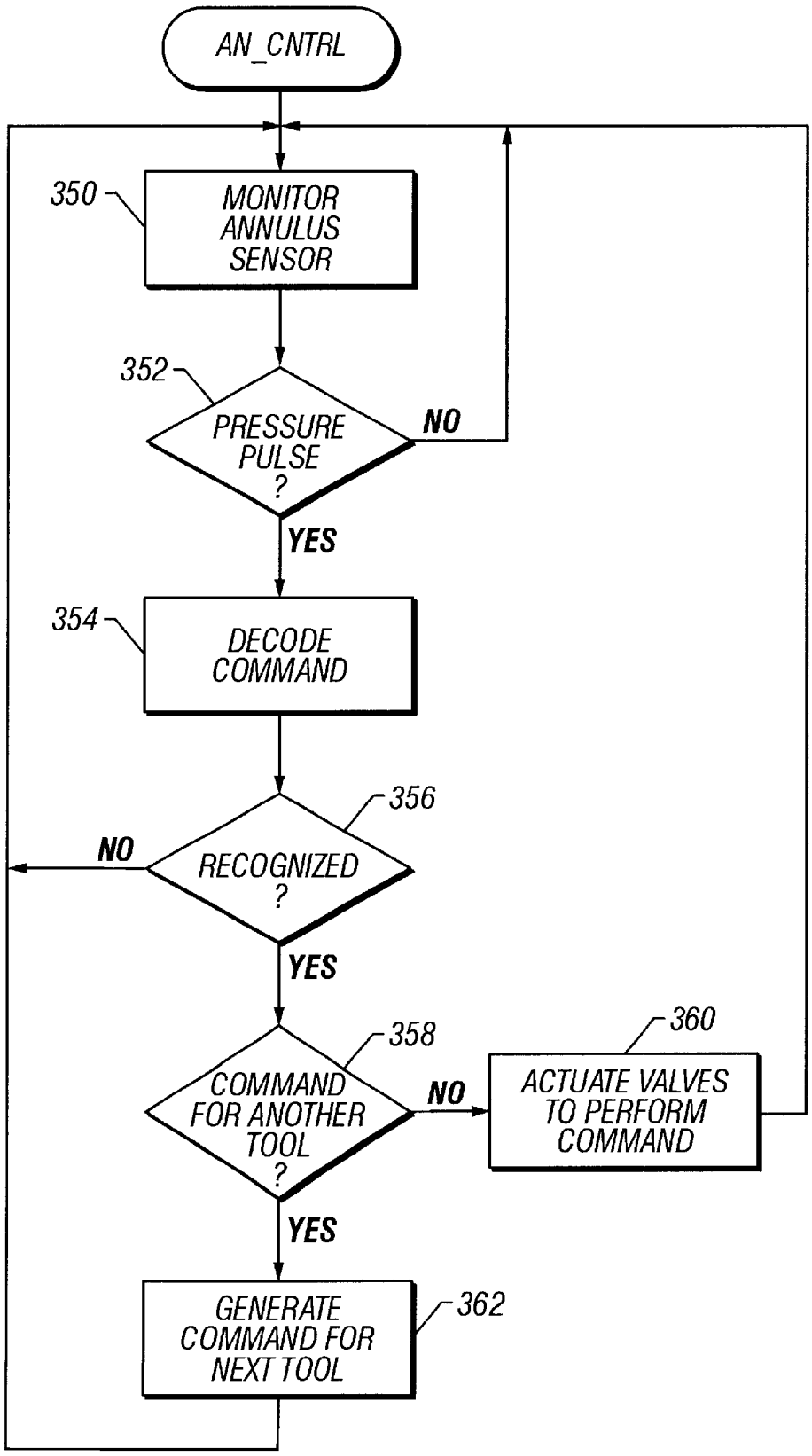
FIGS. 14 and 15 are flow diagrams illustrating the operation of electronics of tools of the test string.

As shown in FIG. 14, the controller 254 of the upper tool 50 executes a routine called AN_CNTRL to decode commands sent by the mud pump 39 and actuate the ball valve 53 accordingly. In the AN_CNTRL routine, the controller 254 monitors 350 the pressure via the sensor 54. If the controller 254 determines 352 that a pressure pulse has not been detected, then the controller 254 returns to step 350. However, if a pressure pulse has been detected, the controller 254 then decodes 354 the command. If the controller 254 does not recognize 356 the command, then the controller 254 returns to step 350. Otherwise, the controller 254 determines 358 whether the command is for another downhole tool (i.e., the lower tool 70). If not, then the controller 254 actuates 360 the valves 51 and 53 to carry out the command and returns to step 350. If the controller 254 determines 358 that the command was for the lower tool 70, then the controller 258 actuates 362 the ball valve 53 to send the command down to the lower tool 70.

Figure 15:
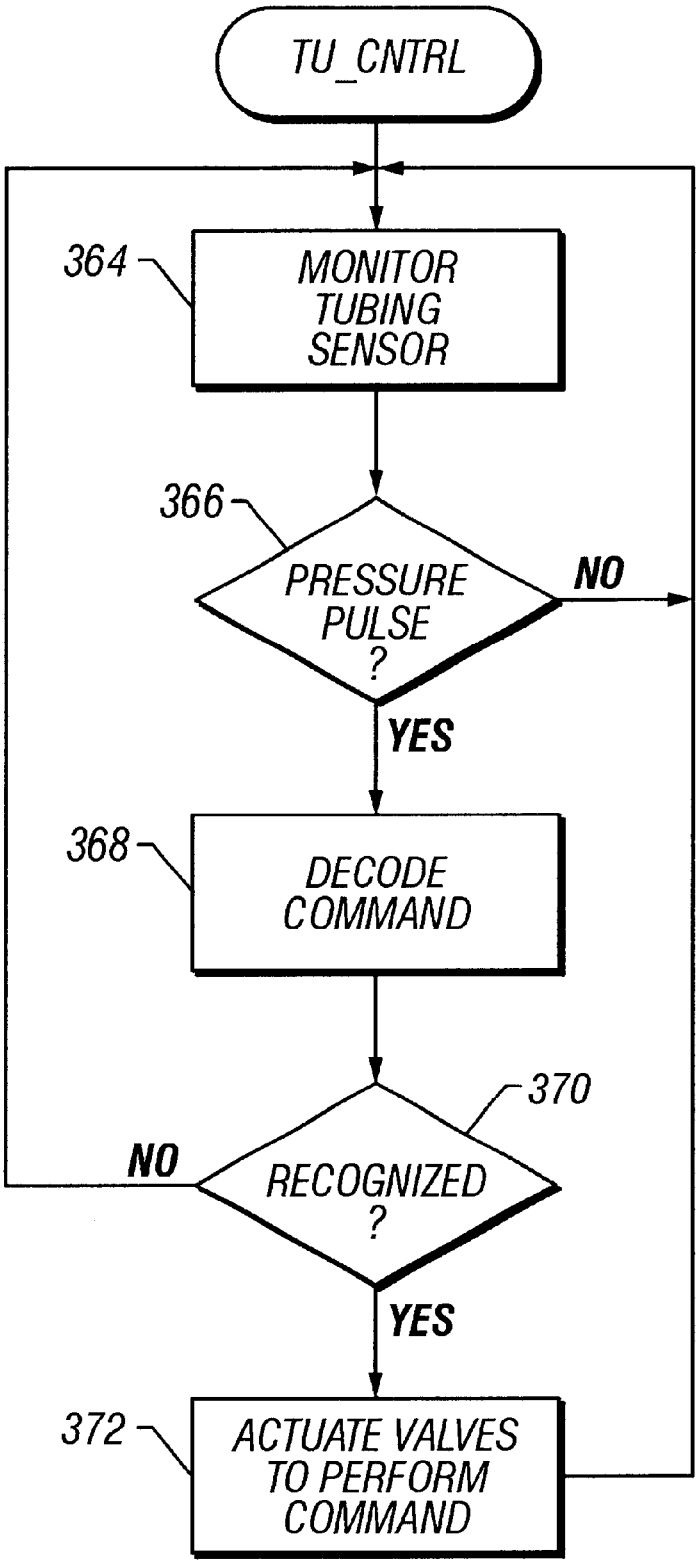

As shown in FIG. 15, in a routine called TU_CNTRL, the controller 254 of the lower tool 70 performs a series of steps to decode commands sent by the upper tool 50. In the TU_CNTRL routine, the controller 254 first monitors 364 the tubing pressure sensor 258. If the controller 254 determines 366 that a pressure pulse was detected, then the controller 254 decodes 368 the command. If the controller.254 recognizes 370 the command, the controller 254 actuates 372 the circulation valve 71 and the ball valve 72 of the lower tool 70 to perform the desired function. The controller 254 then returns to step 364.

In another embodiment, the ball valve 53 is located at the surface of the well. The ball valve 53 is controlled via electrical cables extending to the ball valve 53 (instead of through the pressure pulses 120 transmitted through the upper annulus 43).

Figure 16:
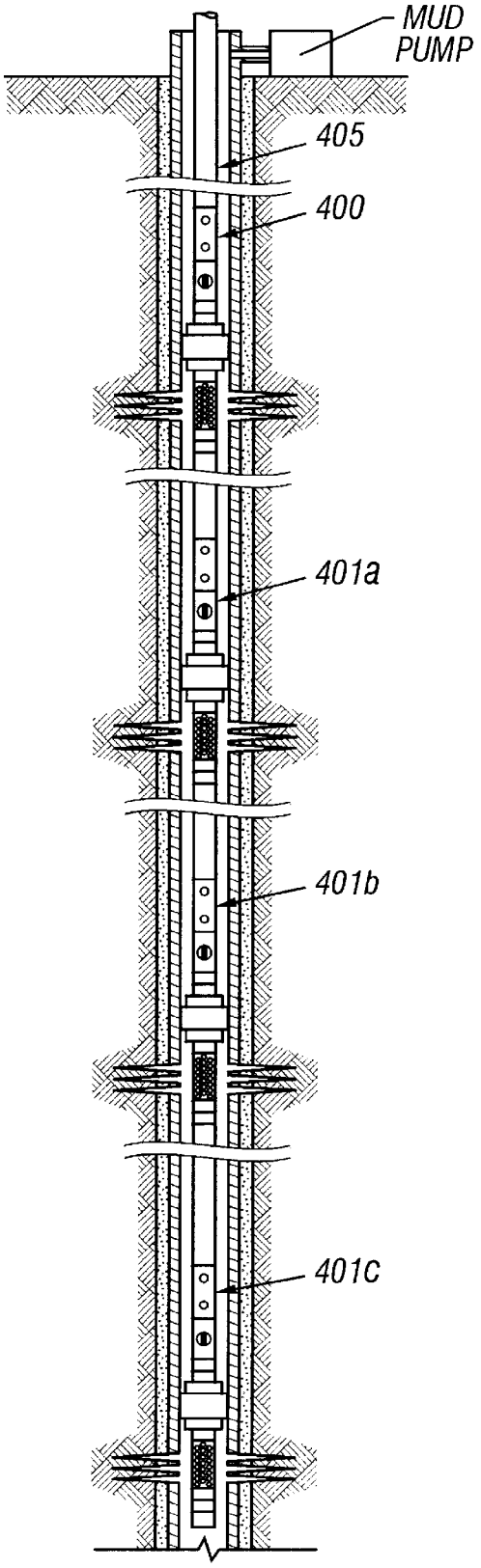
FIG. 16 is a schematic diagram illustrating another test string in a well being tested.

Other embodiments include a test string with more than two downhole tools. For example, as shown in FIG. 16, in a test string 405, one tool 400 generates commands for three tools 401*a–c* located downhole of the tool 400. In order to select the correct tool 401*a–c*, the tool 400 generates the same command more than once. The number of times the tool 400 generates the command identifies the recipient of the command. For example, for the tool 400 to transmit a command to the tool 401*c*, only one command is sent by the tool 400. For the tool 401*b*, the tool 400 sends two commands, and for the tool 401*a*, the tool 400 sends three commands.

Figure 17:
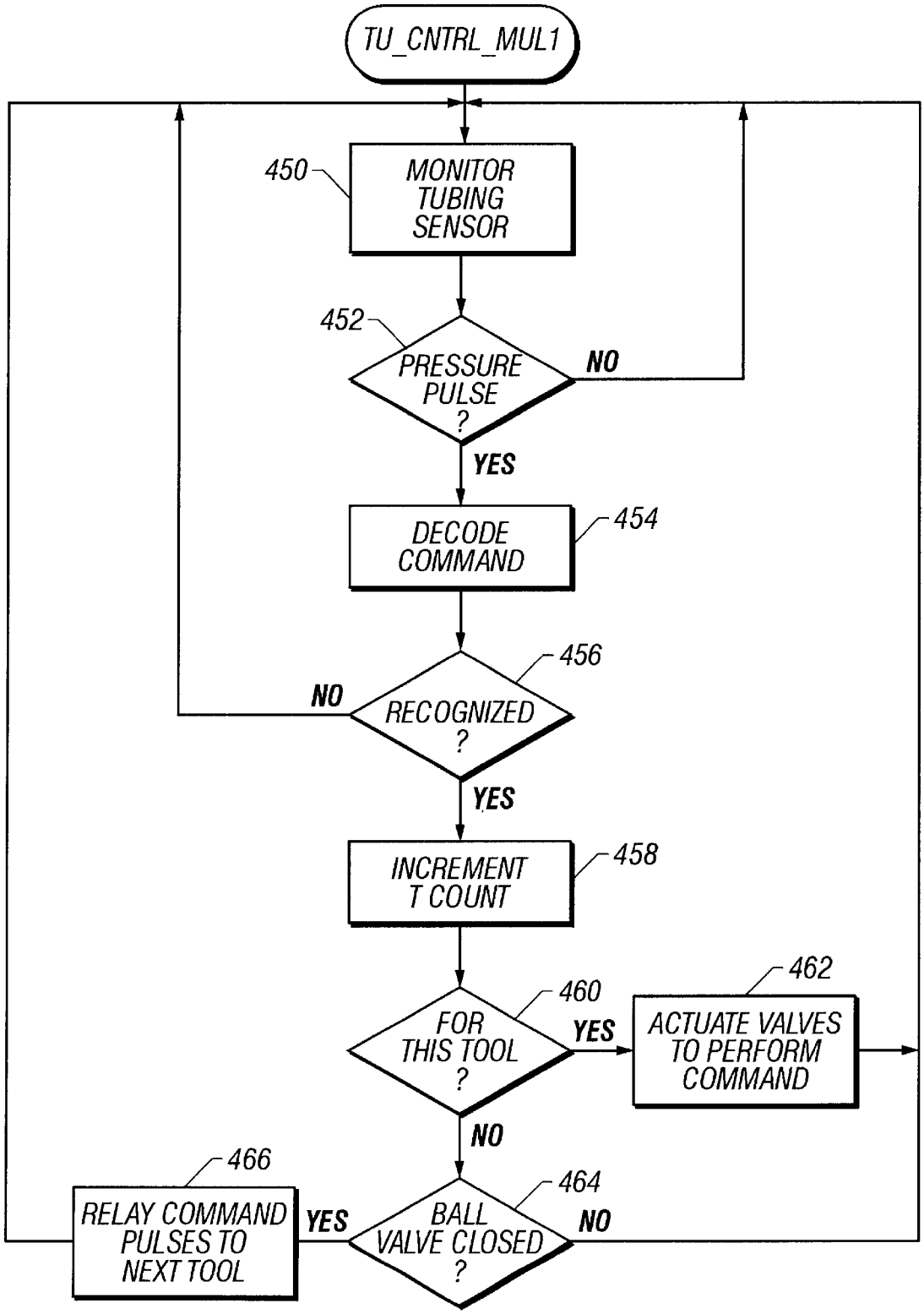
FIGS. 17 and 18 are flow diagrams illustrating the operation of electronics of tools of the test string.

As shown in FIG. 17, for the above-described sequencing method of addressing the tools 401*a–c*, the controller 254 in each of the tools 401*a–c* executes a routine called TU_CNTRL_MUL1. In the TU_CNTRL_MUL1 routine, the controller 254 monitors the pressure tubing sensor 258. If the controller 254 determines 452 that a pressure pulse was detected, then the controller 254 decodes 454 the command. If the controller 254 recognizes 456 the command, then the controller 254 increments 458 a parameter called TCOUNT (set equal to zero on reset of the electronics 250) which indicates the number of times the command has been detected. If the controller 254 determines 460 that the TCOUNT parameter indicates that the tool has been selected, then the controller 254 actuates 462 the valves to perform the command and returns to step 450. If the commands are for a tool located further downhole, then the controller 254 determines 464 whether the ball valve of the tool is closed (i.e., thereby indicating the command did not reach the next tool downhole). If not, the controller 254 returns to step 450. If, however, the ball valve was closed, then the controller 254 401 actuates the ball valve in a manner to send the command downhole.

Figure 18:
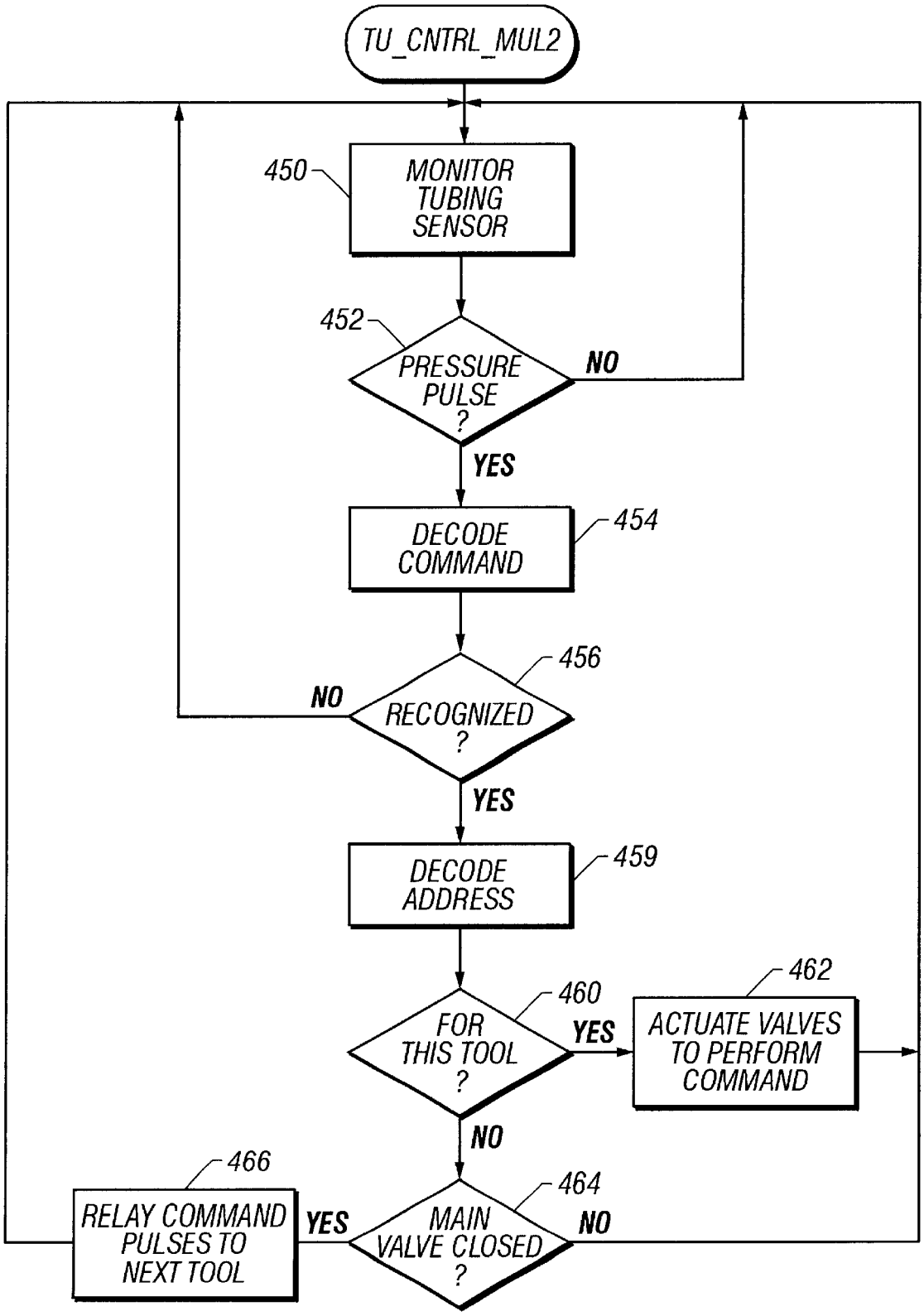

As shown in FIG. 18, in another embodiment, the tool 400 uses pressure pulses in the central passageway of the test string 405 to send an address with the command. The address uniquely identifies one of the downhole tools 401*a–c*. In this embodiment, the controller 254 for each of the tools 401*a–c* executes a routine called TU_CNTRL_MUL2. The TU_CNTRL_MUL2 routine is identical to the TU_CNTRL_MUL1 routine with the exception that step 458 is replaced with a step 478 in which the controller 254 decodes 478 the address sent by the tool 400.

Figure 19:
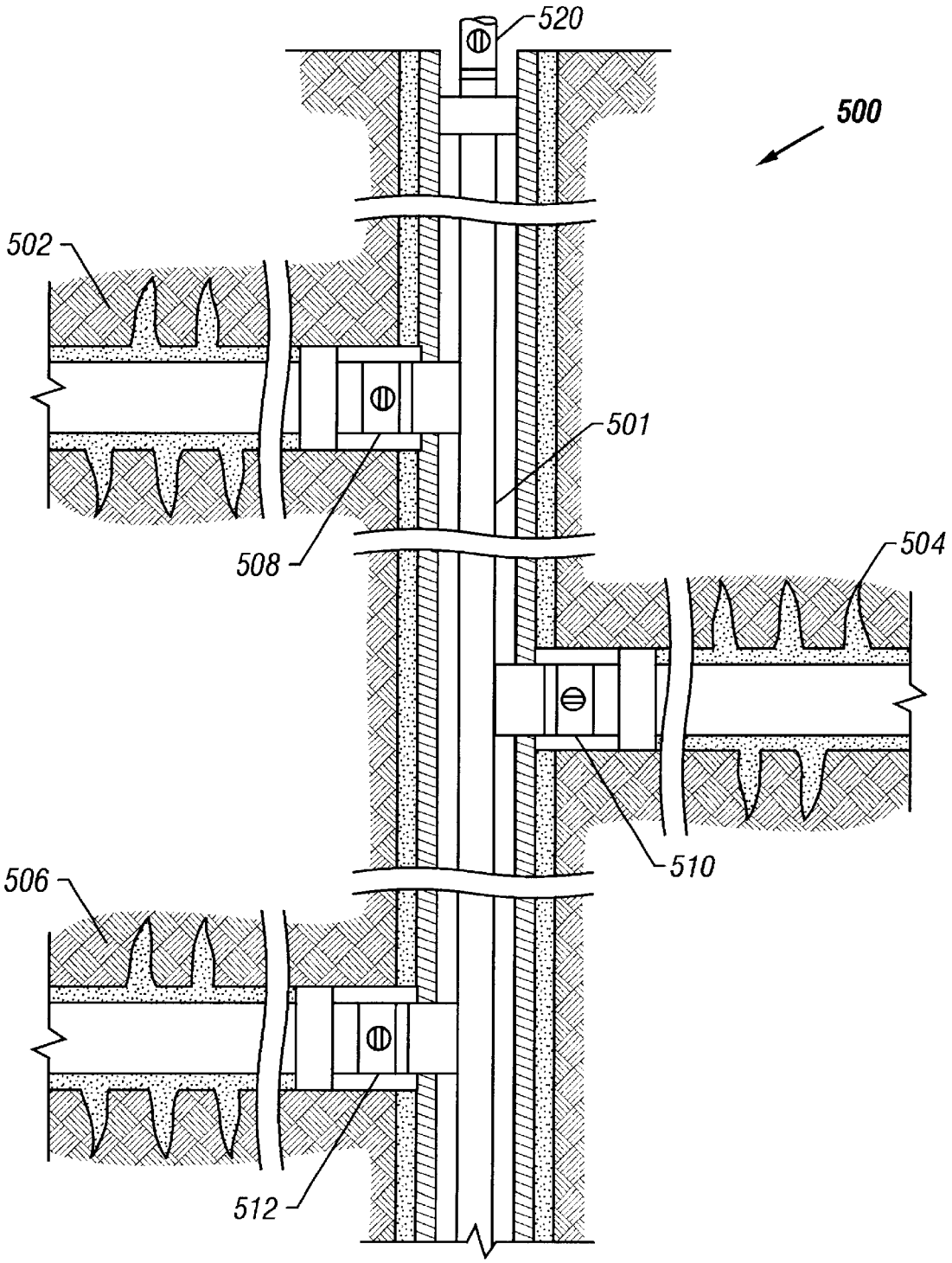
FIG. 19 is a cross-sectional view of a multi-lateral well.

As illustrated in FIG. 19, the control of downhole devices as discussed above may be extended beyond downhole testing strings. In FIG. 19, the principles are applied to an actual production environment. For example, a multi-lateral well 500 may have computer-controlled valve units 508–512 that control the flow of well fluid from lateral wellbores 502–506, respectively, to a trunk 501 of the well 500. Each of the valve units 508–512 has the same electronics 250 and hydraulics 249 discussed above along with a ball valve for controlling the flow of fluid through the central passageway of the valve unit. The flow of the well fluid through the trunk 501 is controlled by a valve unit 520, of similar design to the valve units 508–512.

Figure 20:
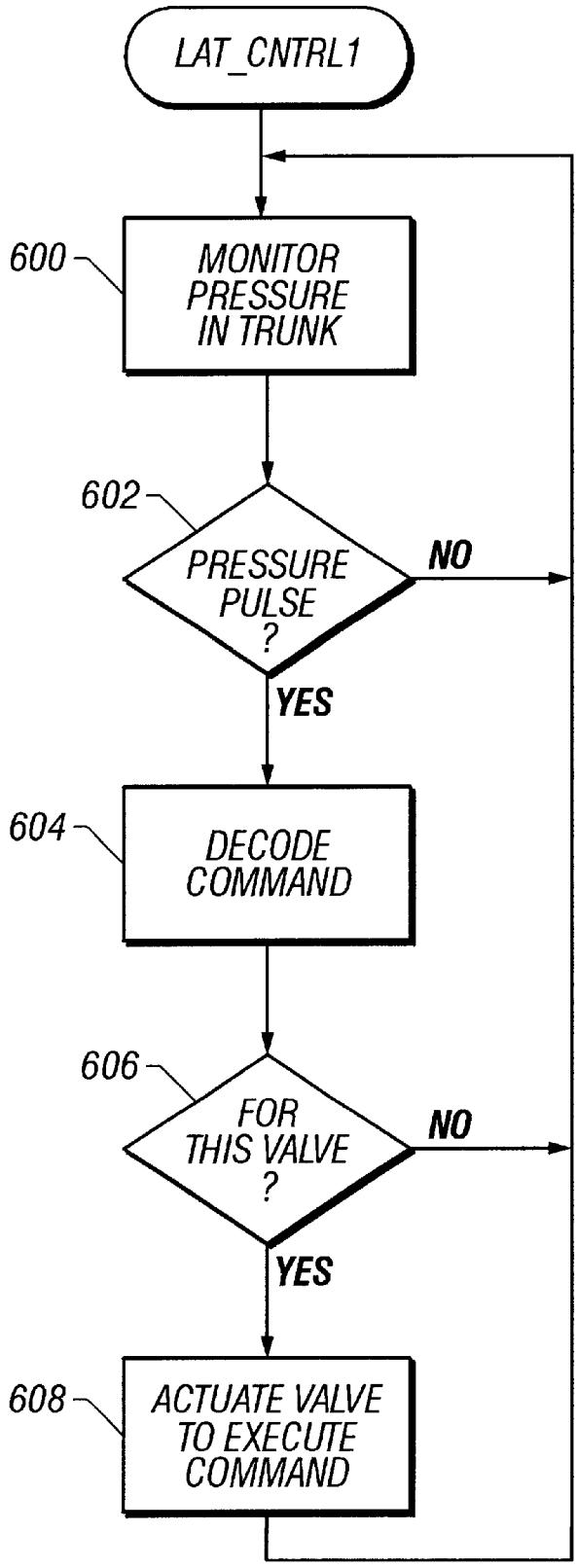
FIGS. 20 and 21 are flow diagrams illustrating the operation of valve units of FIG. 19.

As shown in FIG. 20, the controller 254 in each of the valve units 508–512 executes a routine called LAT_CNTRL1. In the LAT_CNTRL1 routine, the controller 254 monitors 600 the pressure in the trunk 501. If the controller 254 detects 602 a pressure pulse, then the controller 254 decodes 604 the command. If the controller 254 then recognizes 206 the command as being for the valve unit, the controller 254 actuates 608 the ball valve of the valve unit to execute the command.

Figure 21:
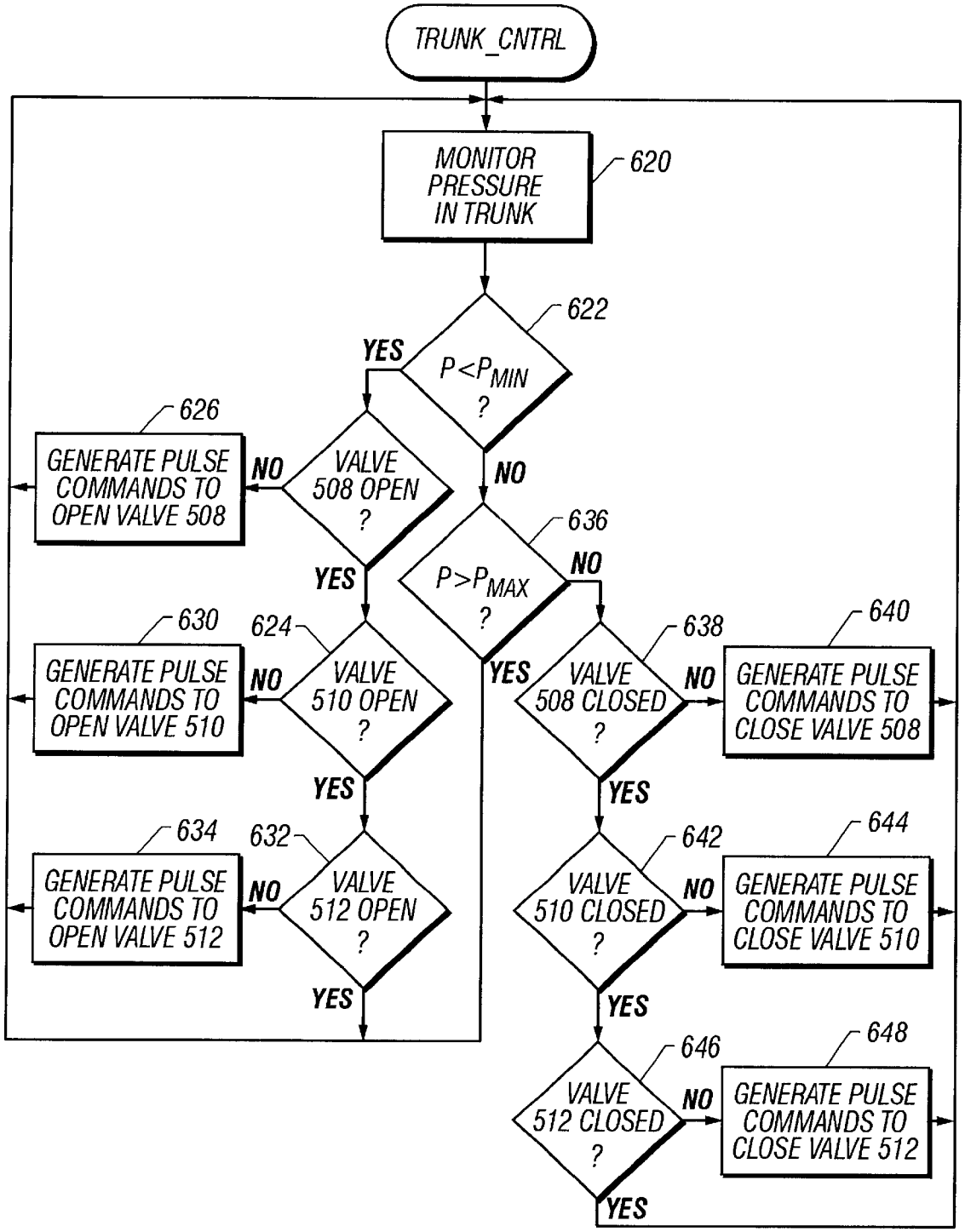

As shown in FIG. 21, the controller 254 for the valve unit 520 executes a routine called TRUNK_CNTRL. In the TRUNK_CNTRL routine, the controller 254 monitors 620 the pressure in the trunk 501. If the controller 254 determines 622 that the pressure has dropped below a predetermined minimum threshold, then the controller 254 performs 624–634 a series of operations to increase the pressure in the trunk 501. The controller 254 first determines 624 whether the valve 508 is open, and if not, the controller 254 then actuates 626 the ball valve of the unit 520 to generate a command to open the valve unit 508. The controller 254 then returns to step 620. If the valve unit 508 is open, then the controller 254 determines 628 whether the valve unit 510 is open, and if not, the controller 254 actuates 630 the ball valve of the valve unit 520 to generate a command to open the valve unit 510 and returns to step 620. If the valve unit 510 is open, then the controller 254 determines 632 whether the valve unit 512 is open, and if so, the controller 254 actuates 634 the ball valve of the unit 520 to generate a command to open the valve unit 512 and returns to step 620.

If the controller 254 determines 636 that the pressure in the trunk 501 is greater than a predetermined maximum threshold, then the controller performs 638–648 steps to reduce the pressure in the trunk. The controller 254 first determines 638 whether the valve unit 508 is closed, and if not, the controller 254 actuates 640 the ball valve of the valve unit 520 to send a command to close the valve unit 508 and returns to step 620. If the controller 254 determines 642 that the valve unit 510 is closed, then the controller 254 actuates 644 the ball valve of the unit 520 to send a command to close the valve unit 510 and returns to step 620. If the controller 254 determines 646 that the valve unit 512 is closed, then the controller 254 actuates 648 the ball valve of the valve unit 520 to send a command to close the valve 512 and returns to step 620.

In other embodiments, the valve unit 520 is located at the surface of the well. The valve unit 520 is controlled via electrical cables connected to the valve unit 520.

Instead of using the mud pump 39 to generate a single command to instruct the upper tool 50 to generate a command for the lower tool 70, in an alternative embodiment, a series of commands is sent by the mud pump 39 to directly control the opening and closing of the ball valve 53 in the generation of the command for the lower tool 70.

Figure 22:
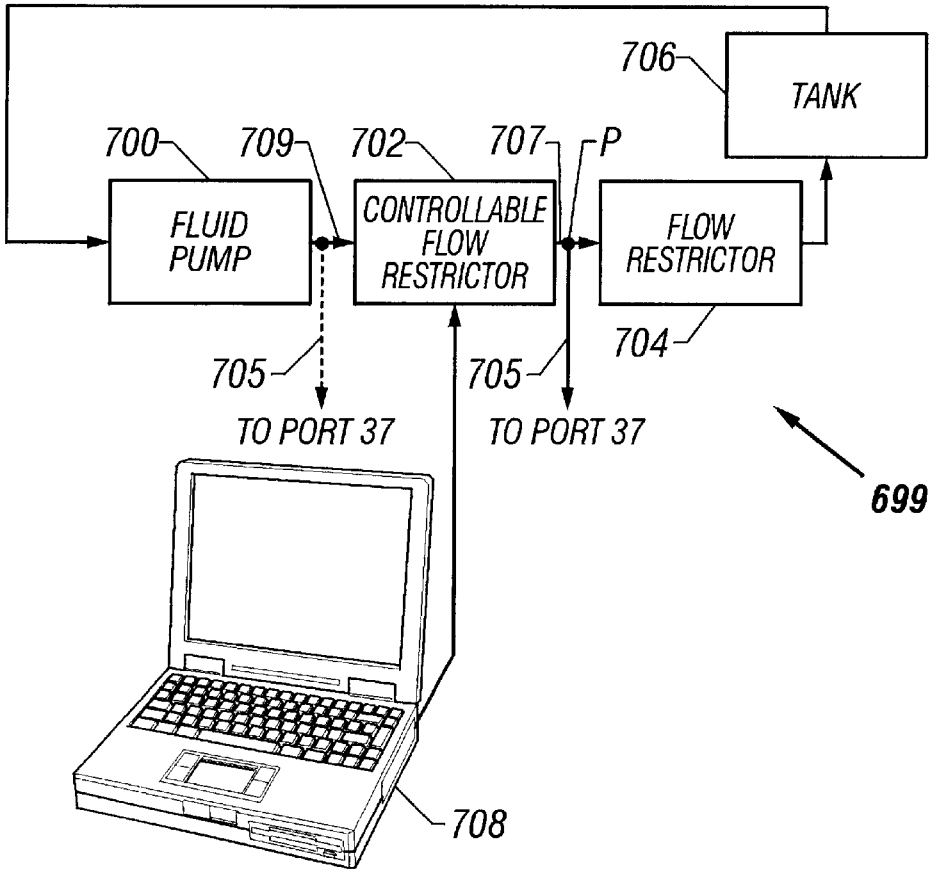
FIG. 22 is a block diagram of a system for generating pressure pulse commands.
Figure 23:
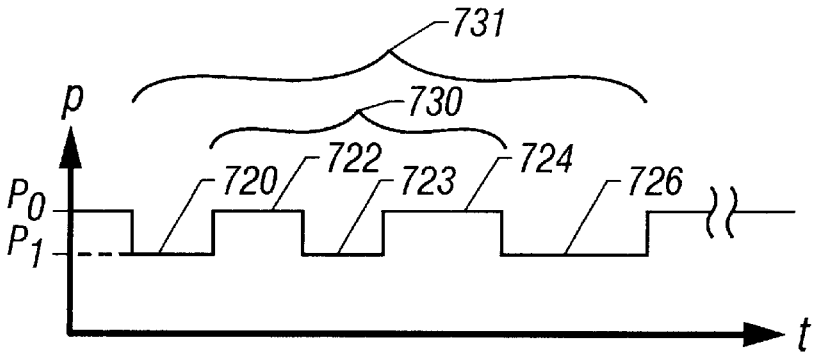
FIG. 23 is a waveform illustrating a pressure pulse command generated by the system of FIG. 22.

Referring to FIGS. 22 and 23, the manually operated pump 39 may be replaced by an automated system 699 for transmitting commands downhole. The advantages of using an automated system to transmit commands downhole may include one or more of the following: pressure pulse commands may be transmitted downhole using a push-button control; timing of the pulses may be precisely controlled and pulse transmission can use advanced encoding scheme; more commands may be transmitted in a shorter period of time; pressure pulses having a shorter duration may be used; operator error may be reduced; and multiple downhole tools may be controlled.

In some embodiments, the automated system 699 includes a fluid pump 700 that circulates a fluid (e.g., liquid mud) into and out of a holding tank 706 and establishes a constant volumetric flow rate for the system 699. A choke, or flow restrictor 704, is located in a flowpath between the pump 700 and the tank 706 and establishes a baseline pressure level $P_0$ (e.g., 100 p.s.i.) for the system 699.

Depending on the particular embodiment, a pressure P (FIG. 23) may be exerted on the hydrostatic fluid in the annulus 43 or in a central passageway of the downhole string by a link, or conduit 705, that is tapped into a flow line 707 that supplies the fluid in the system 699 to the flow restrictor 704. To modulate the pressure P, the system 699 includes a choke, or flow restrictor 702, that is controlled by a computer 708 (e.g., a portable computer) in a manner to send commands downhole by varying the pressure from the baseline pressure $P_0$ that is established by the flow restrictor 704. In some embodiments, the flow restrictor 702 is connected in a flowpath of the fluid between the output of the pump 700 and the input of the flow line 707.

In some embodiments, fluid pump 700; the flow restrictors 702 and 704; and the tank 706 are all located at the top surface of the well to establish a flow path at the surface of the well. Also, in some embodiments, the flow restrictor 702 may be a tool that is similar in design to a measurement while drilling (MWD) tool that is located in the flow loop at the surface of the well and is electrically coupled to the computer 708. In this manner, for the embodiments where an MWD-type tool is used, the portion of the tool that is configured to selectively alter flow may be used to form at least a part (if not all, in some embodiments) of the flow restrictor 702.

Figure 26:
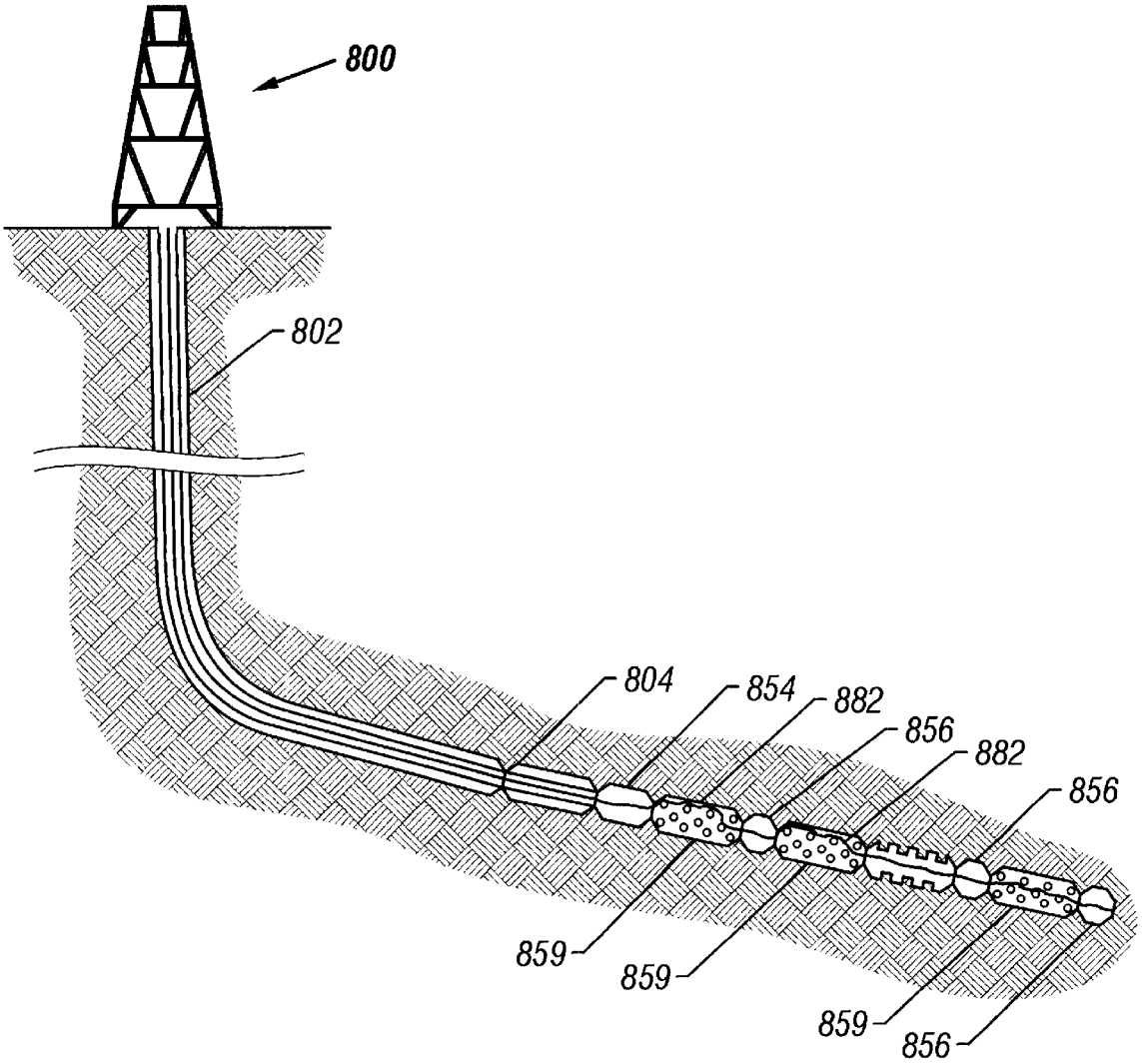
FIG. 26 is a schematic diagram of a string that includes perforating guns.

In some embodiments, the surface flow loop permits the formation of pressure pulses that are transmitted downhole through a stationary fluid. For example, referring to FIG. 26, in a system 800, the pressure pulses may be transmitted downhole via a column of stationary fluid that is located in a central passageway of a string 802. In this manner, a control module 854 may respond to the pressure pulses that may, for example, direct an initiator module 856 to fire its associated perforating gun 859. The control module 854 may communicate with the initiator modules 856 via a signal over a power line 882. In other embodiments, a circulation valve module 804 of the string 802 may be opened to allow the fluid to circulate between the central passageway of the string 802 and an annulus that surrounds the string 802. For these embodiments, the surface flow loop creates pressure pulses in the circulating fluid.

Referring back to FIGS. 22 and 23, the computer 708 modulates the pressure drop across the flow restrictor 702 by selectively throttling, or restricting, the cross-section of the flow path where the fluid passes through the restrictor 702. As a result, the pressure P is modulated. As shown, negative pulses are generated. However, positive pulses may alternatively be generated, as described below.

When the computer 708 instructs the flow restrictor 702 to allow the flow of fluid to pass through the restrictor 702 unrestricted, the pressure P is approximately equal to the baseline pressure level $P_0$, as no appreciable pressure drop occurs across the restrictor 702. To lower the 30 pressure P to a lower predetermined level $P_1$, the computer 708 instructs the flow restrictor 702 to restrict the flow of fluid which results in a pressure drop across the flow restrictor 702.

Thus, the commands are formed by modulating the pressure on the hydrostatic fluid in the annulus 43 between the pressure levels $P_0$ and $P_1$. FIG. 23 depicts an example of a transmission sequence 731 in which a signature 730 of pressure pulses are transmitted. The computer 708 indicates the beginning of the sequence 731 by lowering the pressure P to the pressure level $P_1$ to transmit a logic zero start pulse 720. The computer 708 then modulates the pressure, as described above, to transmit negative pressure pulses 722, 723, and 724 of the signature 730. The pressure pulses 722–724 include logic one pressure pulses 722 and 724 and a logic zero pressure pulse 723. The completion of the sequence 731 is indicated by a logic zero, stop pulse 726 which has a longer duration than the other logic zero pulses (e.g., pulse 723) of the sequence 731.

In other embodiments, the conduit 705 may be alternatively tapped into a flow line 709 that supplies fluid from the fluid pump 700 to the flow restrictor 702. As a result of this arrangement, the flow restrictor 702 creates positive (instead of negative) pressure pulses in manner similar to that described above.

Figure 24:
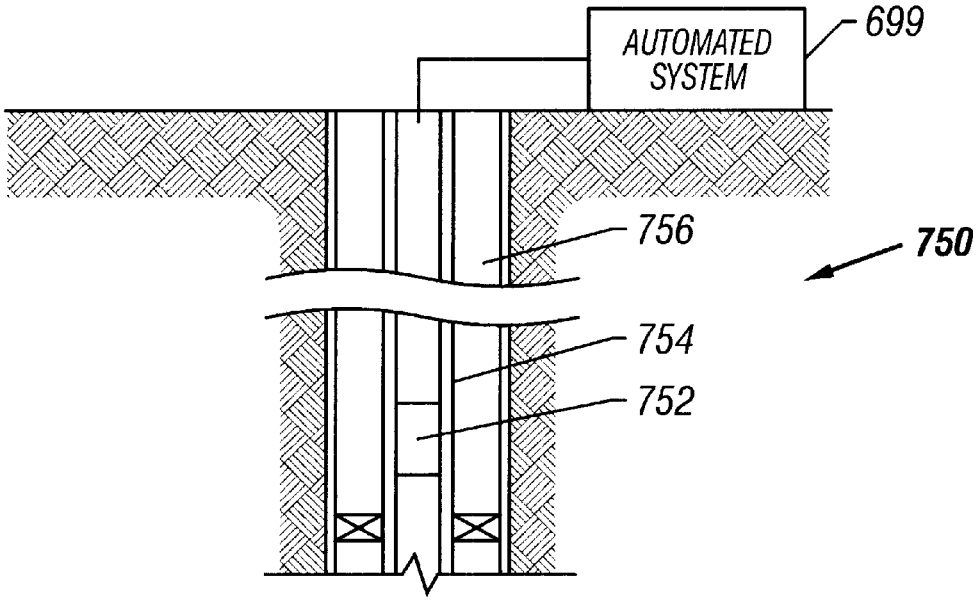
FIGS. 24 and 25 are schematic diagrams of wells.
Figure 25:
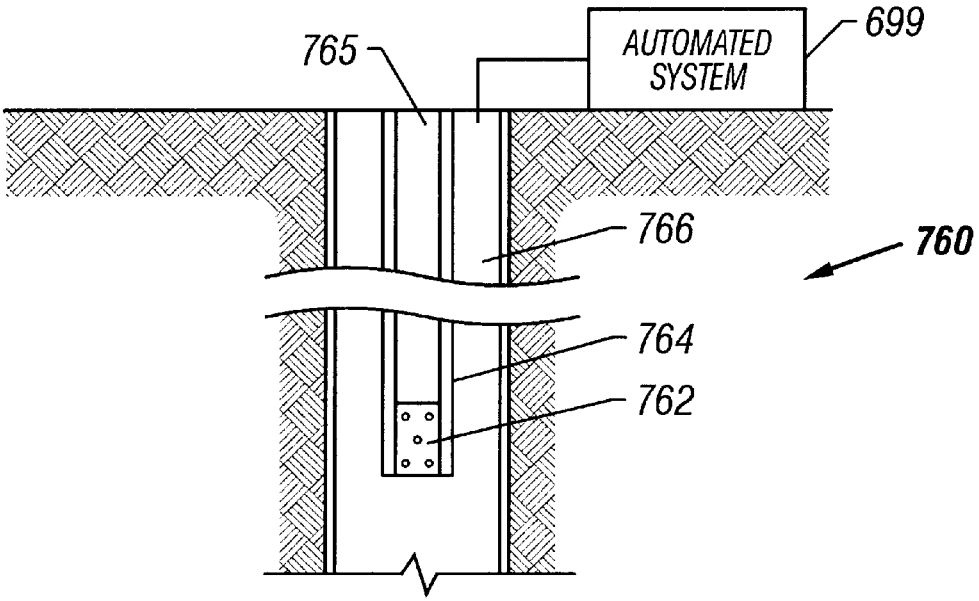

Thus, referring to FIG. 24, the automated system 699 may be used, as an example, in a well 750 to create pressure pulses in an annulus 756 to control a valve of a downhole testing tool 752 (part of a test string 754). As another example, in a well 760 (see FIG. 25), the automated system 699 may be used to.send commands downhole via a center passageway 765 of a tubing 764 instead of sending commands via an annulus 766 that surrounds the tubing 764. In this manner, the automated system 699 may be used to modulate the pressure of fluid in the tubing 765 to operate, for example, a perforating gun 762 that is in fluid communication with the fluid in the tubing 764.

Figure 27:
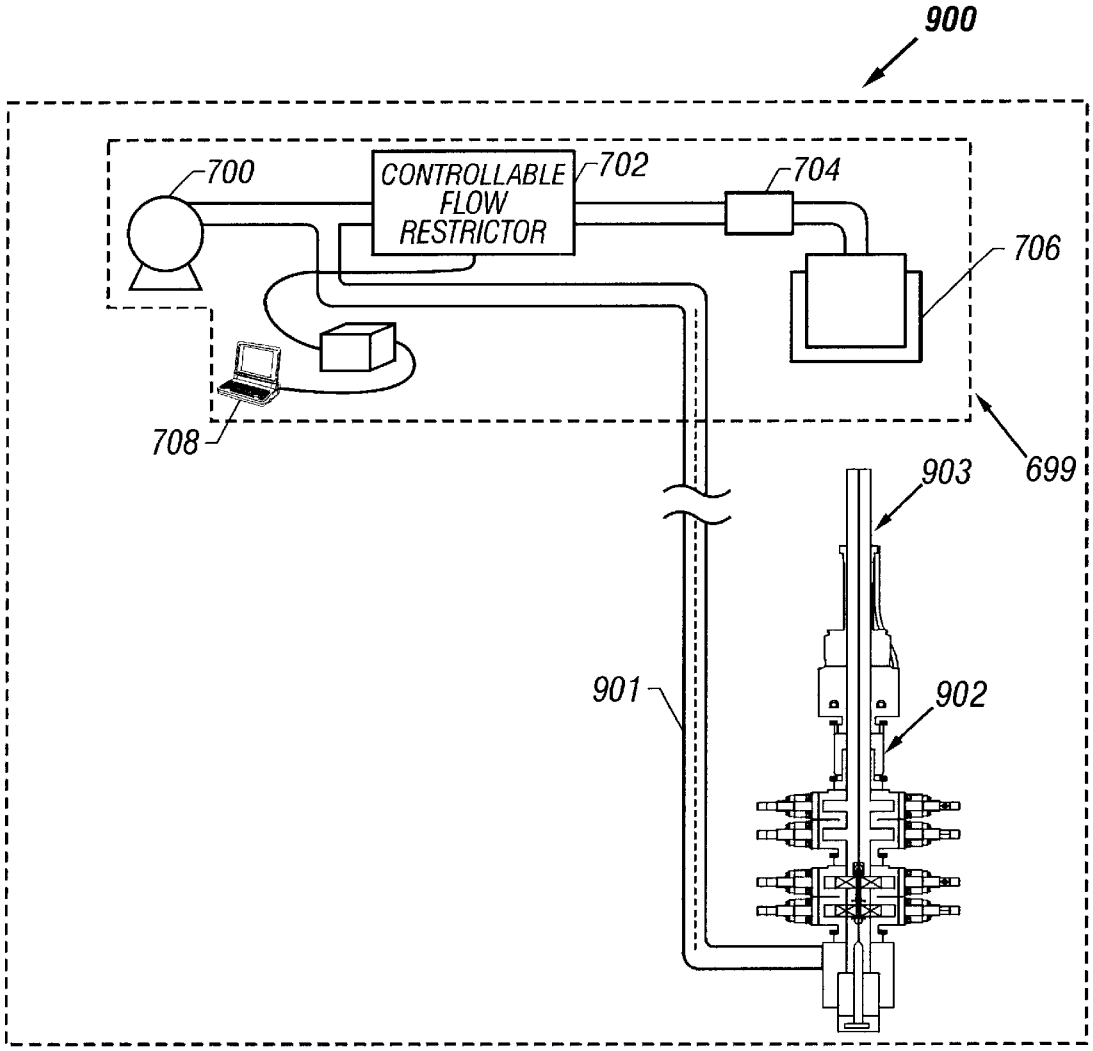
FIG. 27 is a schematic diagram of a subsea system according to an embodiment of the invention.

Referring to FIG. 27, the automated system 699 may be used in a subsea well system 900 in some embodiments of the invention. In this manner, the conduit 901 may be a choke or kill line that extends from a floating platform as an integral part of a marine riser (for example) down to a subsea BOP 902. The BOP 902 is located just above the sea floor and is secured to a wellhead 924 (see FIG. 28) of the subsea well. The choke and kill lines typically are used for purposes of applying pressure to and releasing pressure from the BOP for purposes of actuating some mechanism (inside the BOP 902) that directly responds to the pressure. However, unlike conventional systems, the line 901 is used to communicate command-encoded pressure pulses to a tool assembly 903 that is located (as depicted in FIG. 27) inside the BOP 902 and is constructed to respond to the commands that are encoded in the pressure pulses. Therefore, due to this arrangement, the tool assembly 903 does not need to be connected to a surface platform (for example) via a tethered electro/hydraulic line (called an umbilical) for purposes of communicating command-encoded pressure pulses to the tool assembly 903. Instead, as described below, the pressure pulses are communicated via fluid in the pre-existing (choke or kill) line 901 that is coupled between the BOP 902 and the system 699. In some embodiments of the invention, the line 901 is isolated from the well bore fluids, as the line 901 is isolated from the central passageway of the tool assembly 903.

Figure 28:
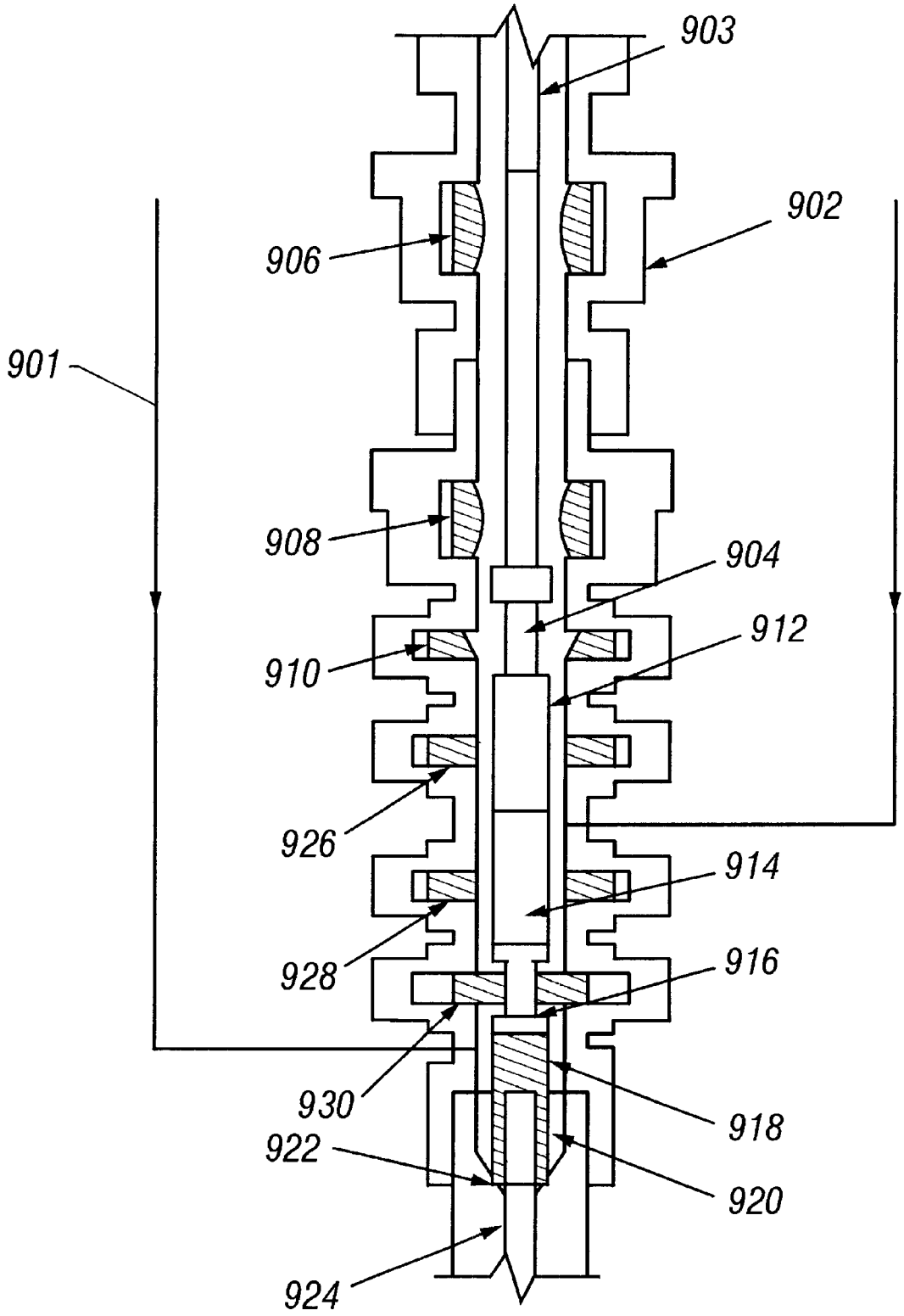
FIG. 28 is a schematic diagram of a BOP of the system of FIG. 27 according to an embodiment of the invention.

Referring to FIG. 28, in some embodiments of the invention, the tool assembly 903 may be used to secure a tubing hanger 920 to the wellhead 924. In this manner, the tubing hanger 920 is located at the bottom end of the tool assembly 903 and is releasable secured to the remainder of the tool assembly 903 via a hydraulically actuated tubing hanger running tool 918. The tubing hanger running tool 918 is latched to the tubing hanger 920 when the tool assembly 903 is first run into the BOP 902. After the tubing hanger 920 is placed in the appropriate position in the wellhead 924, the system 699 may be used to communicate (via pressure pulses in the line 901) a command (called TH LOCK) to the tool assembly 903 to cause the assembly 903 to lock the tubing hanger 920 to the wellhead 924. Subsequently, the system 699 may be used to communicate (via pressure pulses in the line 901) another command (called THRT UNLATCH) to the tool assembly 903 to, cause the tubing hanger running tool 918 to release, or unlatch, the tubing hanger 920 from the tool assembly 903. The tool assembly 903 may then be retrieved from the BOP 902, leaving the tubing hanger 920 secured to the wellhead 924.

The running of the tool assembly 903 into the BOP 902 and the retrieval of the tool assembly 903 from the BOP 902 may be accomplished via a marine riser, as can be appreciated by those skilled in the art.

In some embodiments of the invention, the tool assembly 903 may include a module 914 that, when tool assembly 903 is placed in the appropriate position inside the BOP 902, is in communication with the fluid in the line 901. The module 914 includes a pressure transducer to detect pressure pulses and electronics to decode commands from the detected pressure pulses. Once a particular command is decoded and recognized as a command for the tool assembly 903, the module 914 operates the accumulator module 912 to supply the hydraulic force necessary to actuate the tubing hanger running tool 918 to perform the command.

In this manner, in some embodiments of the invention, the accumulator module 912 may generally include pressurized gas (nitrogen, for example) for purposes of applying a force on hydraulic fluid that is in communication with the tubing hanger running tool 918. The selective application of this force (as controlled by the module 914) serves to operate the tubing hanger running tool 918 and may also directly operate the tubing hanger 920, in some embodiments of the invention. More specifically, the module 914 may operate a valve of the accumulator module 912 to control a pressure signature that the accumulator module 912 applies to the hydraulic fluid. By controlling the operations of this valve, the module 914 may control when the tubing hanger 920 locks to or unlocks from the wellhead 924 and may control when the tubing hanger running tool 918 latches to or unlatches from the tubing hanger 920. As described below, the fluid communication between the line 901 and the module 914 and the fluid communication between the module 914 and the tubing hanger running tool 918 is established by a ported slick joint 916, further described below.

The BOP 902, in some embodiments of the invention, may include annular sealing elements 906 and 908 to form dynamic seals that, during the running of a pipe or tubing (such as the tool assembly 903) into the BOP 902, allow movement of the tubing or pipe while providing the desired seal. The BOP 902 may also include shear rams 910 that shear and seal on a pipe or tubing to prevent well blow out due to an unexpected increase in wellbore pressure. Pipe rams 926 and 928 are used to close on a pipe or tubing, and pipe ram 930 is used to close on the ported slick joint 916. A shear ram 910 of the BOP 902 may be used to shear off the pipe or tubing inside the BOP 902 (at a shearable joint, such as a joint 904 of the tool assembly 903) to prevent a blowout.

Figure 29:
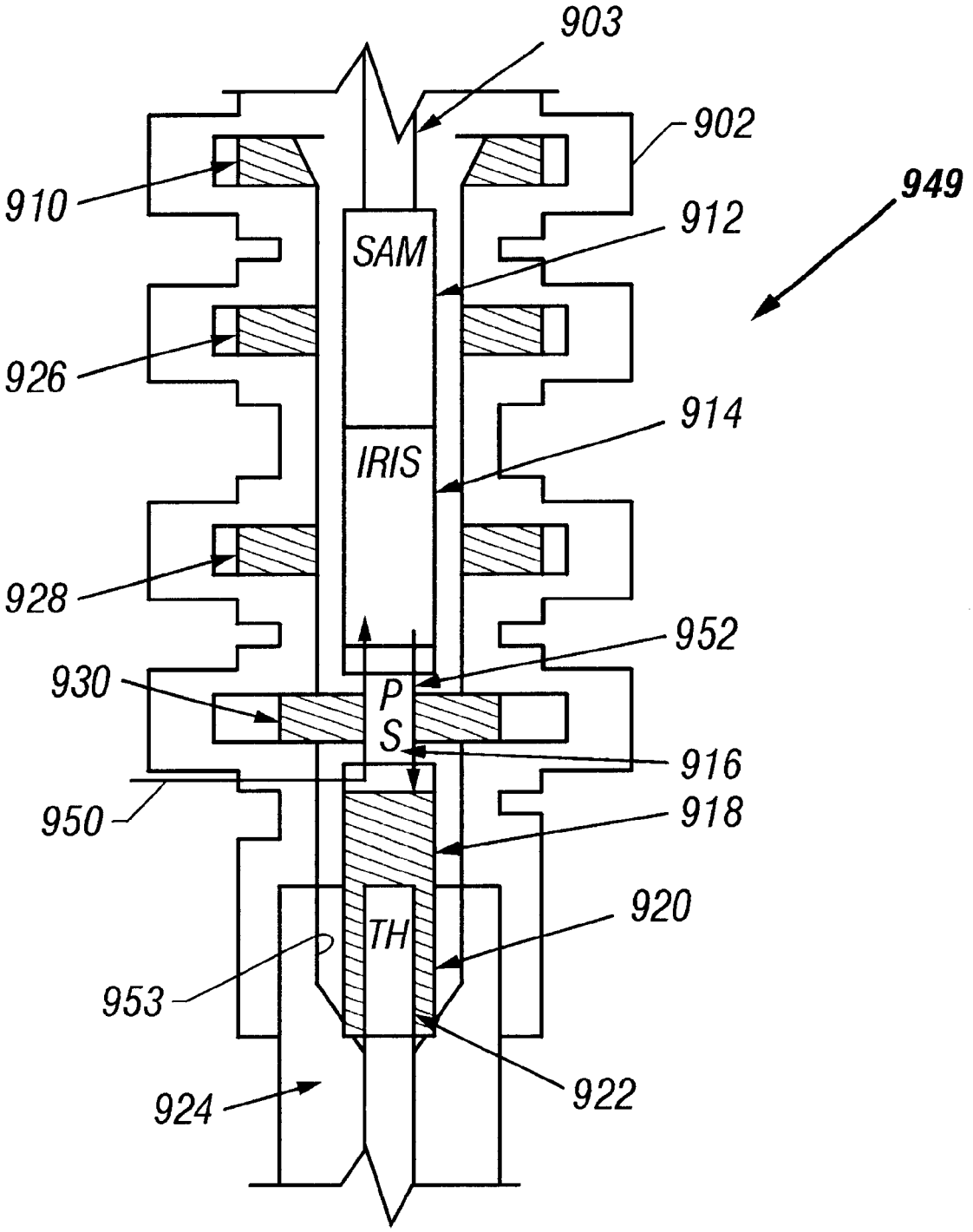
FIG. 29 is a more detailed schematic diagram of a tool assembly of the BOP according to an embodiment of the invention.

Referring to FIG. 29, in some embodiments of the invention, the pipe ram 930 may be closed on the ported slick joint 916 to create a sealed annular region 953 inside the BOP 902 between the pipe ram 930 and a seal 922 that is located between the tubing hanger 920 and the wellhead 924. The sealed annular region 953, in turn, is in fluid communication with the line 901 and one or more ports of the ported slick joint 916. These ports are in fluid communication with the module 914. Therefore, when the pipe ram 930 closes on the ported slick joint 916, a sealed fluid communication path 950 is established between the line 901 and the module 914, thereby permitting command-encoded pressure pulses to be communicated through the line 901 and to the module 914.

The ported slick joint 916 also includes one or more ports to establish communication between the module 914 and the tubing hanger running tool 918 to establish a fluid communication path 952 for hydraulically controlling the tool 918.

Figure 30:
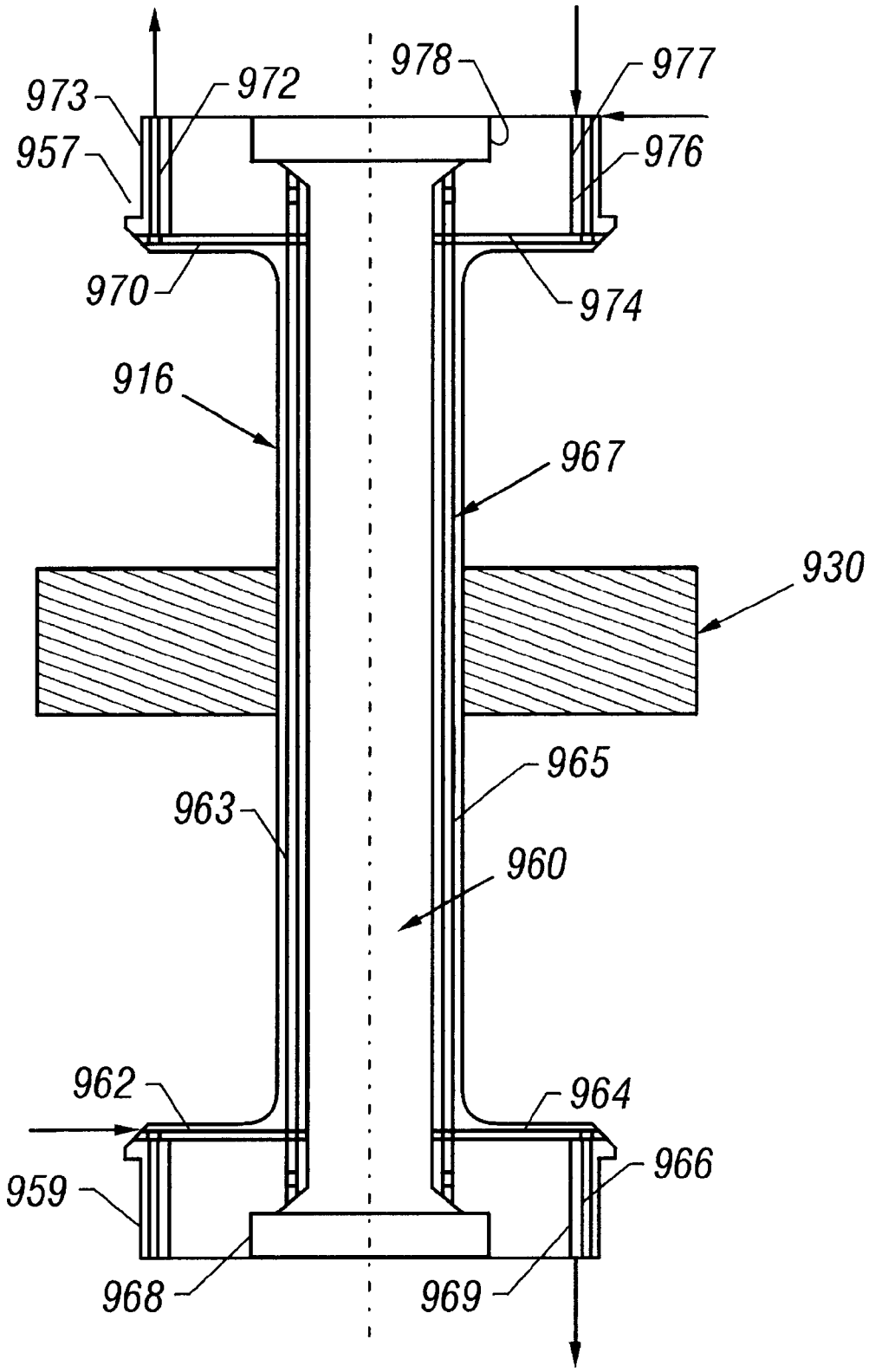
FIG. 30 is a cross-sectional view of a ported slick joint of the tool assembly according to an embodiment of the invention.

FIG. 30 depicts a cross-sectional view of an embodiment of the ported slick joint 916. As shown, the ported slick joint 916 includes a tubular section 967 that extends along the longitudinal axis of the tool assembly 903 through the Tram 930. The central passageway 960 of the tubular section 967 may be used to communicate well fluids. The wall of the tubular section 967 includes longitudinal ports, such as ports 963 and 965 that are depicted in FIG. 30. The port 963 establishes fluid communication between the annular region 953 and the module 914, and the port 965 establishes fluid communication between the module 914 and the tubing hanger running tool 918. Although only one port 963 and one port 965 are shown in the figure, it is understood that, depending on the needs of the operator and the system, a plurality of ports 963 and a plurality of ports 965 may be defined on ported slick joint 967.

A lower flange 959 of the ported slick joint 916 includes a port 962 that is in communication with the port 963 and radially extends from the port 963 to the outside of the ported slick joint 916 to establish communication with the annular region 953. A port 964 in the lower flange 959 of the ported slick joint 916 is in communication with the port 965 and radially extends from the port 965 to a longitudinally extending port 966 that establishes communication with the tubing hanger running tool 918. An external opening 969 of the port 966 may be constructed to be stabbed by a mating connector of the tubing hanger running tool 918. A lower opening 968 of the lower flange 959 may be constructed to form a mating connection with a corresponding tubular element of the tubing hanger running tool 918.

An upper flange 957 of the ported slick joint 916 includes a port 970 that is in communication with the port 963 and radially extends from the port 963. The port 970, in turn, is in communication with a longitudinally extending port 972 that extends to the outside of the ported slick joint 916 to establish communication with the module 914. An external opening 973 of the port 972 may be constructed to be stabbed by a mating connector of the module 914. A port 974 in the upper flange of the ported slick joint 916 is in communication with the port 967 and radially extends from the port 967 to a longitudinally extending port 976 that establishes communication with the tubing hanger running tool 918. An external opening 977 of the port 976 may be constructed to be stabbed by a mating connector of the module 914. An upper opening 978 of the upper flange 957 may be constructed to form a mating connection with a corresponding tubular element of the module 914.

Figure 31:
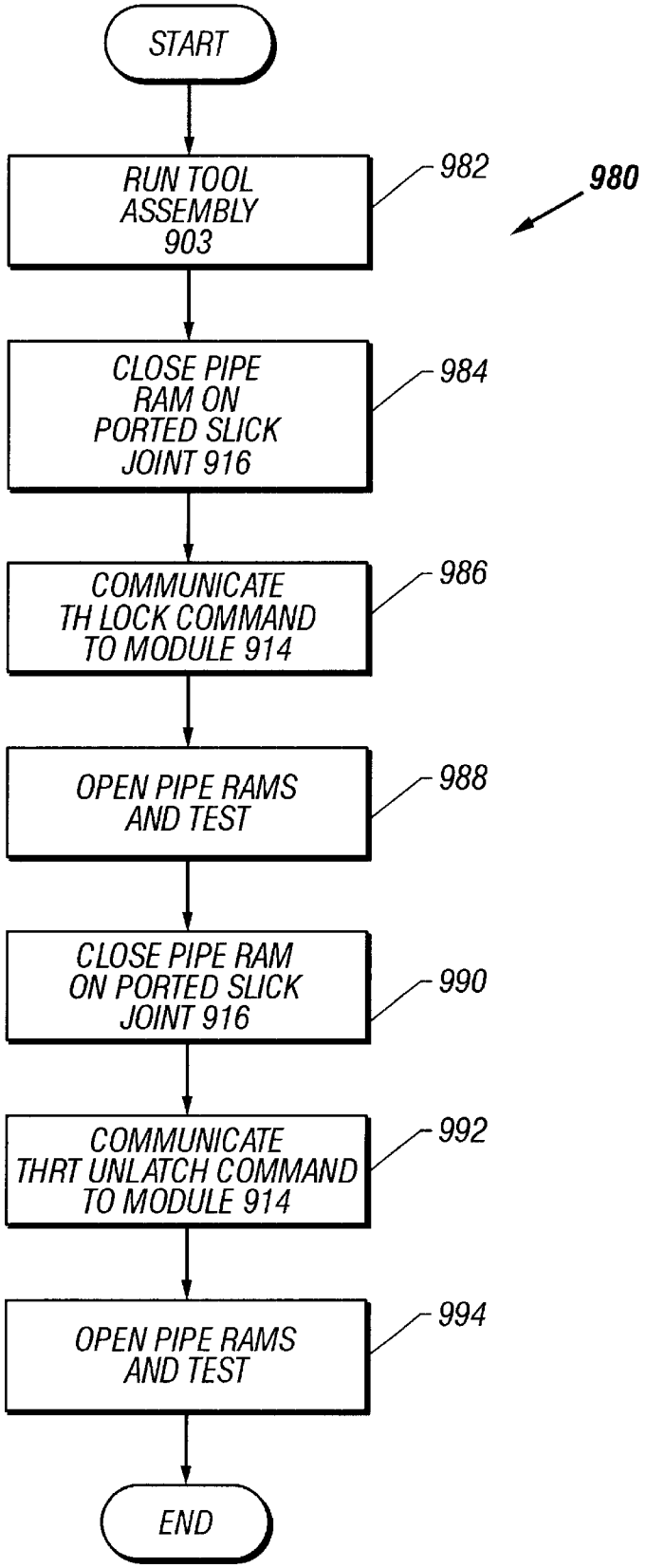
FIG. 31 is a flow diagram depicting a technique to use the tool assembly according to an embodiment of the invention.

Referring to FIG. 31, a technique 980 may be used in some embodiments of the invention to attach the tubing hanger 920 to the wellhead 924. The technique 980 includes running (block 982) the tool assembly 903 into the BOP 902. Next, the pipe ram 930 is closed (block 984) on the ported slick joint 916. Subsequently, the system 699 is used to communicate the appropriate pressure pulses down the line 901 to communicate (block 986) a TH LOCK command to the module 914 so that the tool assembly 903 locks the tubing hanger 920 to the wellhead 924. In some embodiments of the invention, the tubing assembly 903 may acknowledge that the TH LOCK command has been executed by releasing pressure in the line 901 through, for example, another of the kill or choke lines. In this manner, the corresponding drop in pressure at the surface vessel indicates completion of a commanded sequence.

After the TH LOCK command has been communicated (and possibly acknowledged by the tool assembly 903), the pipe rams 930 are released and a test is performed to determine if the tubing hanger 920 is attached to the wellhead 924, as depicted in block 988. As an example, an upward force may be applied to the tool assembly 903 to determine if the tubing hanger 920 is attached to the wellhead 924. Assuming that the test reveals that the tubing hanger 920 is locked to the wellhead 924, the pipe ram 930 is closed (block 990) on the ported slick joint 916, and the system 699 communicates the appropriate pressure pulses down the line 901 to transmit the THRT UNLATCH command to the tool assembly 903, as depicted in block 992. In some embodiments of the invention, the tubing assembly 903 may acknowledge that the THRT UNLATCH command has been executed by releasing pressure in the line 901 through, for example, another of the kill or choke lines.

After the TH UNLATCH command has been communicated (and possibly acknowledged by the tool assembly 903), the pipe ram 930 is released and a test is performed to determine if the tubing hanger running tool 918 has released the tubing hanger 920, as depicted in block 994. As an example, an upward force may be applied to the tool assembly 903 to determine if the tubing hanger running tool 918 has released the tubing hanger 920.

In addition to the operations detailed above, the module 914 and the remainder of the system may be configured so that any number of other operations are triggered upon receipt of the appropriate stimulus through line 901.

Moreover, this system may be used to operate other tools located in the marine riser, BOP, or even in the subterranean environment. A line, which is not carried within the marine riser, the BOP, or the subterranean wellbore, is connected to a location on the marine riser, the BOP, or the subterranean wellbore, that is in fluid communication with the pressure transducer of the module that operates the relevant tool. Upon receipt of the appropriate stimulus, the module then operates the relevant tool. The tools may include packers, sliding sleeves, valves, flow control devices, or plugs, to name but just a few.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A method usable with a subsea well and a well tool that is responsive to a stimulus, the method comprising:

circulating a fluid in a flow path at a surface of the subsea well;

selectively altering flow of the fluid; and furnishing the stimulus to the tool in response to the altering of the flow of the fluid.

2. The method of claim 1, further comprising:

furnishing the stimulus to a control line that extends to the subsea well.

3. The method of claim 2, further comprising:

connecting the control line to a blowout preventer.

4. The method of claim 2, further comprising:

establishing communication between a pressure transducer and the control line; and using the transducer to detect the pressure pulse.

5. The method of claim 1, further comprising:

activating a well tool in response to a detection of a pressure pulse.

6. The method of claim 5, wherein the well tool is selected from a packer, a sliding sleeve, a valve, a flow control device and a plug.

7. A method for telemetering, comprising:

circulating a fluid in a flowpath located at a surface of a subsea well;

selectively altering the flow of the fluid;

furnishing a pressure pulse to a hydraulic control line that runs near a well conduit in response to the altering of the flow of the fluid; and detecting the pressure pulse.

8. The method of claim 7, further comprising:

generating the pressure pulse in a hydraulic control line that is in communication with a blow out preventer.

9. The method of claim 7, further comprising:

generating the pressure pulse in a choke line of a blow out preventer.

10. The method of claim 7, further comprising:

generating the pressure pulse in a kill line of a blow out preventer.

11. The method of claim 7, further comprising:

actuating a tool in response to the detected pressure pulse.

12. The method of claim 11, wherein the tool is a tubing hanger.

13. The method of claim 7, wherein the well conduit is a riser.

14. The method of claim 7, wherein the well conduit is a well casing.

15. The method of claim 7, further comprising:

actuating a sensor in response to the detected pressure pulse.

16. The method of claim 7, further comprising:

providing a module in communication with the control line.

17. The method of claim 16, wherein:

the module comprises a pressure transducer, a control electronics, and a fluid actuator.

18. The method of claim 7, further comprising:

setting a tubing hanger in a wellhead in response to the detecting step.

19. A method usable with a subsea well and a well tool that is responsive to a pressure pulse, the method comprising:

furnishing a control line that runs outside the well conduit;

circulating a fluid in a flowpath at a surface of the subsea well;

selectively altering flow of the fluid;

furnishing a pressure pulse to the control line in response to the altering of the flow of the fluid;

communicating the pressure pulse to the well tool; and detecting the pressure pulse.

20. The method of claim 19, further comprising connecting the control line to a marine riser.

21. The method of claim 19, further comprising connecting the control line to a blow out preventer.

22. The method of claim 19, wherein the control line is in communication with a pressure transducer that operates the well tool.

23. The method of claim 19, wherein the well tool is selected from packers, sliding sleeves, valves, flow control devices, and plugs.

* * * * *